US011039261B2

(12) United States Patent
Liu

(10) Patent No.: US 11,039,261 B2
(45) Date of Patent: Jun. 15, 2021

(54) AUDIO SIGNAL PROCESSING METHOD, TERMINAL AND STORAGE MEDIUM THEREOF

(71) Applicant: GUANGZHOU KUGOU COMPUTER TECHNOLOGY CO., LTD., Guangzhou (CN)

(72) Inventor: Jiaze Liu, Guangzhou (CN)

(73) Assignee: GUANGZHOU KUGOU COMPUTER TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 16/618,069

(22) PCT Filed: Nov. 30, 2018

(86) PCT No.: PCT/CN2018/118764
§ 371 (c)(1),
(2) Date: Nov. 27, 2019

(87) PCT Pub. No.: WO2019/128629
PCT Pub. Date: Jul. 4, 2019

(65) Prior Publication Data

US 2020/0267486 A1 Aug. 20, 2020

(30) Foreign Application Priority Data

Dec. 26, 2017 (CN) ..... 201711432680.4

(51) Int. Cl.
*H04S 5/00* (2006.01)
*H04R 3/04* (2006.01)
(Continued)

(52) U.S. Cl.
CPC ..... *H04S 5/005* (2013.01); *H04R 3/04* (2013.01); *H04R 3/12* (2013.01); *H04R 5/04* (2013.01); *H04S 7/307* (2013.01); *H04S 2400/07* (2013.01)

(58) Field of Classification Search
CPC ... H04S 5/00; H04S 5/005; H04S 5/02; H04S 7/307; H04S 2400/07; H04S 2420/01;
(Continued)

(56) References Cited

U.S. PATENT DOCUMENTS 5,742,689 A * 4/1998 Tucker ..... H04S 3/004 381/17
5,764,777 A * 6/1998 Goldfarb ..... H04R 1/02 381/27
(Continued)

FOREIGN PATENT DOCUMENTS

CN 1294782 A 5/2001
CN 1402592 A 3/2003
(Continued)

OTHER PUBLICATIONS

Chao, Wang, "The Study of Virtual Multichannel Surround Sound Reproduction Technology", "Dissertation Submitted to Shanghai Jiao Tong University for the Degree of Master", Jan. 2009, p. 79, Published in: CN.
(Continued)

*Primary Examiner* — Fan S Tsang
*Assistant Examiner* — Daniel R Sellers
(74) *Attorney, Agent, or Firm* — Neugeboren O'Dowd PC

(57) ABSTRACT

An audio signal processing method. The audio signal processing method includes: acquiring a first stereo audio signal; splitting the first stereo audio signal into 5.1-channel audio signals; obtaining processed 5.1-channel audio signals by processing the 5.1-channel audio signals based on a
(Continued)

speaker box parameter of a three-dimensional surround 5.1-channel virtual speaker box; and synthesizing the processed 5.1-channel audio signals into a second stereo audio signal.

14 Claims, 9 Drawing Sheets

(51) Int. Cl.
*H04R 3/12* (2006.01)
*H04R 5/04* (2006.01)
*H04S 7/00* (2006.01)

(58) Field of Classification Search
CPC ..... H04S 2400/05; H04R 3/04; H04R 3/12; H04R 5/04
See application file for complete search history.

(56) References Cited

U.S. PATENT DOCUMENTS

| | | | | |
|---|---|---|---|---|
| 7,243,073 | B2 | 7/2007 | Yeh et al. | |
| 9,820,073 | B1 | 11/2017 | Foti | |
| 2002/0159607 | A1 | 10/2002 | Ford et al. | |
| 2007/0223708 | A1* | 9/2007 | Villemoes | H04S 3/004 381/17 |
| 2007/0288110 | A1* | 12/2007 | Inoue | H04S 3/00 700/94 |
| 2009/0185693 | A1 | 7/2009 | Johnston et al. | |
| 2009/0214045 | A1* | 8/2009 | Fukui | H04S 3/004 381/17 |
| 2010/0296672 | A1* | 11/2010 | Vickers | H04S 5/00 381/119 |
| 2016/0269847 | A1 | 9/2016 | Par | |
| 2017/0272863 | A1 | 9/2017 | Mentz | |
| 2020/0112812 | A1 | 4/2020 | Liu | |

FOREIGN PATENT DOCUMENTS

| | | | |
|---|---|---|---|
| CN | 1791285 | A | 6/2006 |
| CN | 101645268 | A | 2/2010 |
| CN | 101695151 | A | 4/2010 |
| CN | 101878416 | A | 11/2010 |
| CN | 105900170 | A | 11/2010 |
| CN | 101902679 | A | 12/2010 |
| CN | 102568470 | A | 7/2012 |
| CN | 102883245 | A | 1/2013 |
| CN | 103237287 | A | 8/2013 |
| CN | 103377655 | A | 10/2013 |
| CN | 104103279 | A | 10/2014 |
| CN | 104464725 | A | 3/2015 |
| CN | 104581602 | A | 4/2015 |
| CN | 105788612 | A | 7/2016 |
| CN | 104091601 | A | 8/2016 |
| CN | 105869621 | A | 8/2016 |
| CN | 105872253 | A | 8/2016 |
| CN | 106652986 | A | 5/2017 |
| CN | 107040862 | A | 8/2017 |
| CN | 107077849 | A | 8/2017 |
| CN | 107863095 | A | 3/2018 |
| CN | 108156561 | A | 6/2018 |
| CN | 108156575 | A | 6/2018 |
| CN | 109036457 | A | 12/2018 |
| EP | 1610588 | A2 | 12/2005 |
| EP | 2629552 | A1 | 8/2013 |
| EP | 3197182 | A1 | 7/2017 |
| WO | 2017165968 | A1 | 10/2017 |

OTHER PUBLICATIONS

CNIPA, "Office Action Regarding Chinese Patent Application No. 20171142680.4", dated Mar. 11, 2019, p. 13, Published in: CN.

International Searching Authority, "International Search Report and Written Opinion Re PCT/CN2018/118764", dated Jan. 23, 2019, p. 17 Published in: CN.

Zhao, Yi et al., "Multi-Channel Audio Signal Retrieval Based on Multi-Factor Data Mining With Tensor Decomposition", "Proceedings of the 19th International Conference on Digital Signal Processing", Aug. 20, 2014, p. 5.

CNIPA, "Office Action Re Chinese Patent Application No. 201711436811.6", dated May 5, 2019, p. 11 Published in: CN.

International Searching Authority, "International Search Report and Written Opinion Re PCT/CN2018/115928", dated Dec. 19, 2018, p. 19 Published in: CN.

International Searching Authority, "International Search Report and Written Opinion Re PCT/CN2018/118766", dated Jan. 14, 2019, p. 18 Published in: CN.

PCT, "International Search Report and Written Opinion Regarding International Application No. PCT/CN2018/117766", dated Jun. 11, 2019, p. 21 Published in: CN.

Jeon Se-Woon et al, "Robust Representation of Spatial Sound in Stereo-to-Multichannel Upmix", "AES Conveti on 128; May 2010, AES, 60 East 42nd Street, Room 2520 New York 10165-2520, USA", May 1, 2010, p. 8, entire document.

Streckfuss, Martin, "Extended European search report of counterpart EP application No. 18894607.3 dated Jul. 29, 2020", dated Jul. 29, 2020, p. 11 Published in: EP.

Carlos Avendano et al, "Ambience extraction and synthesis from stereo signals for multi-channel audio up-mix", "2002 IEEE International Conference on Acoustics, Speech, and Signal Processing. Proceedings. (ICASSP). Orlando, FL, May 13-17, 2002", May 13-17, 2002, pp. II-1957-II-1960, entire document.

* cited by examiner

AUDIO SIGNAL PROCESSING METHOD, TERMINAL AND STORAGE MEDIUM THEREOF

This application is a National Stage of International Application No. PCT/CN2018/118764, filed on Nov. 30, 2018, which claims priority to Chinese Patent Application No. 201711432680.4, filed on Dec. 26, 2017 and entitled "AUDIO SIGNAL PROCESSING METHOD AND APPARATUS, AND TERMINAL THEREOF", the entire contents of which are incorporated herein by reference.

TECHNICAL FIELD

The present disclosure relates to the field of audio processing technology, and in particular, relates to an audio signal processing method and apparatus, and a terminal and a storage medium thereof.

BACKGROUND

In related art, an audio playback device plays a double-channel audio signal by an audio playback unit, such as a double-channel earphone or a double-channel speaker, such that a user may achieve a stereo effect.

SUMMARY

Embodiments of the present disclosure provide an audio signal processing method, a terminal and a storage medium thereof.

In an aspect, embodiments of the present disclosure provide an audio signal processing method. The method is performed by a terminal, and includes:

acquiring a first stereo audio signal;

splitting the first stereo audio signal into 5.1-channel audio signals;

obtaining processed 5.1-channel audio signals by processing the 5.1-channel audio signals based on a speaker box parameter of a three-dimensional surround 5.1-channel virtual speaker box; and synthesizing the processed 5.1-channel audio signals into a second stereo audio signal.

In another aspect, embodiments of the present disclosure provide a terminal. The terminal includes a processor and a memory, wherein at least one instruction is stored in the memory, and loaded and executed by the processor to perform following processing:

acquire a first stereo audio signal;

split the first stereo audio signal into 5.1-channel audio signals;

obtain processed 5.1-channel audio signals by processing the 5.1-channel audio signals based on a speaker box parameter of a three-dimensional surround 5.1-channel virtual speaker box; and synthesize the processed 5.1-channel audio signals into a second stereo audio signal.

In another aspect, embodiments of the present disclosure provide a computer-readable storage medium, wherein at least one instruction is stored in the storage medium, and loaded and executed by a processor to perform following processing:

following processing:

acquire a first stereo audio signal;

split the first stereo audio signal into 5.1-channel audio signals;

obtain processed 5.1-channel audio signals by processing the 5.1-channel audio signals based on a speaker box parameter of a three-dimensional surround 5.1-channel virtual speaker box; and synthesize the processed 5.1-channel audio signals into a second stereo audio signal.

BRIEF DESCRIPTION OF THE DRAWINGS

For clearer descriptions of the technical solutions in the embodiments of the present disclosure, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without any creative efforts.

DETAILED DESCRIPTION

For clearer descriptions of the objectives, the technical solutions and the advantages of the present disclosure, the embodiments of the present disclosure are further described in detail hereinafter with reference to the accompanying drawings.

In related art, the double-channel audio signal is an audio signal formed by superimposing a left-channel audio signal over a right-channel audio signal. The audio playback unit plays the left-channel audio signal by a left-channel portion and plays the right-channel audio signal by a right-channel portion. The user obtains a stereo impression by a phase difference between the left-channel audio signal played by the left-channel portion and the right-channel audio signal played by the right-channel portion.

In the related art, the audio playback unit plays the left-channel audio signal and the right-channel audio signal such that the user obtains the stereo impression. Since sound travels in multiple directions, the stereo effect is relatively poor when only the two channels of audio signals are played.

Figure 1:
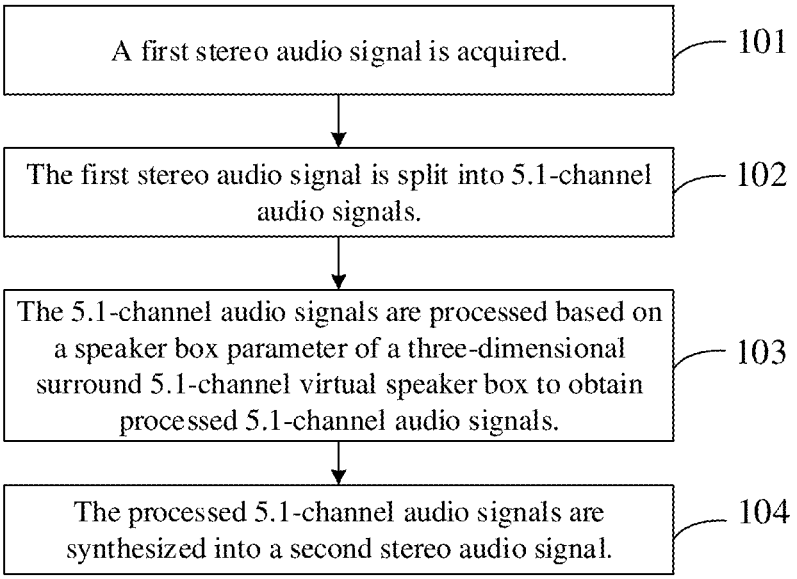
FIG. 1 is a flowchart of an audio signal processing method in accordance with an exemplary embodiment of the present disclosure.

FIG. 1 is a flowchart of an audio signal processing method in accordance with an exemplary embodiment of the present disclosure, which may solve the problem that the stereo effect is relatively poor when the left-channel audio signal and the right-channel audio signal are played by the audio playback unit. The method may be performed by a terminal with an audio signal processing function, and includes the following steps.

In step 101, a first stereo audio signal is acquired.

The terminal reads a locally stored first stereo audio signal, or acquires the first stereo audio signal on a server by a wired or wireless network.

The first stereo audio signal is obtained by sound recording by a stereo recording device, which usually includes a first microphone on a left side and a second microphone on a right side. The stereo recording device records sound on the left side and sound on the right side by the first microphone and the second microphone respectively to obtain a left-channel audio signal and a right-channel audio signal. The stereo recording device superimposes the left-channel audio signal over the right-channel audio signal to obtain the first stereo signal.

Optionally, the received first stereo audio signal is stored in a buffer of the terminal and denoted as X_PCM.

The terminal stores the received first stereo audio signal in a built-in buffer area in the form of a sample pair of the left-channel audio signal and the corresponding right-channel audio signal and acquires the first stereo audio signal from the buffer area for use.

In step 102, the first stereo audio signal is split into 5.1-channel audio signals.

The terminal splits the first stereo audio signal into the 5.1-channel audio signals by a preset algorithm. The 5.1-channel audio signals include a front left-channel signal, a front right-channel signal, a front center-channel signal, a low-frequency channel signal, a rear left-channel signal and a rear right-channel signal.

In step 103, the 5.1-channel audio signals are processed based on a speaker box parameter of a three-dimensional surround 5.1-channel virtual speaker box to obtain processed 5.1-channel audio signals.

The terminal processes the 5.1-channel audio signals based on the speaker box parameter of the three-dimensional surround 5.1-channel virtual speaker box to obtain the processed 5.1-channel audio signals.

The processed 5.1-channel audio signals include a processed front left-channel signal, a processed front right-channel signal, a processed front center-channel signal, a processed low-frequency channel signal, a processed rear left-channel signal and a processed rear right-channel signal.

The three-dimensional surround 5.1-channel virtual speaker box is an audio model preset by the terminal, and simulates the playback effect of a 5.1-channel speaker box that surrounds a user in a real scene.

In the real scene, centered by the user and taking the direction in which the user faces towards as front, the 5.1-channel speaker box includes a front left speaker box at the left front side of the user, a front right speaker box at the right front side of the user, a front center speaker box right ahead the user, a low-frequency speaker box (not limited in location), a rear left speaker box at the left rear side of the user and a rear right speaker box at the right rear side of the user.

In step 104, the processed 5.1-channel audio signals are synthesized into a second stereo audio signal.

The terminal synthesizes the processed 5.1-channel audio signals into the second stereo audio signal, which may be played by a common stereo earphone, a 2.0 speaker box or the like. The user may enjoy a 5.1-channel stereo effect upon hearing the second stereo audio signal of the common stereo earphone or the 2.0 speaker box.

In summary, according to the method provided by the embodiment, the first stereo audio signal is split into the 5.1-channel audio signals, which are processed and synthesized into the second stereo audio signal, and the second stereo audio signal is played by a double-channel audio playback unit, such that the user enjoys a 5.1-channel audio stereo effect. The present disclosure solves the problem in the related art that a relatively poor stereo effect is caused by only playing two channels of audio signals. Further, a stereo effect in audio playback is improved.

Figure 8:
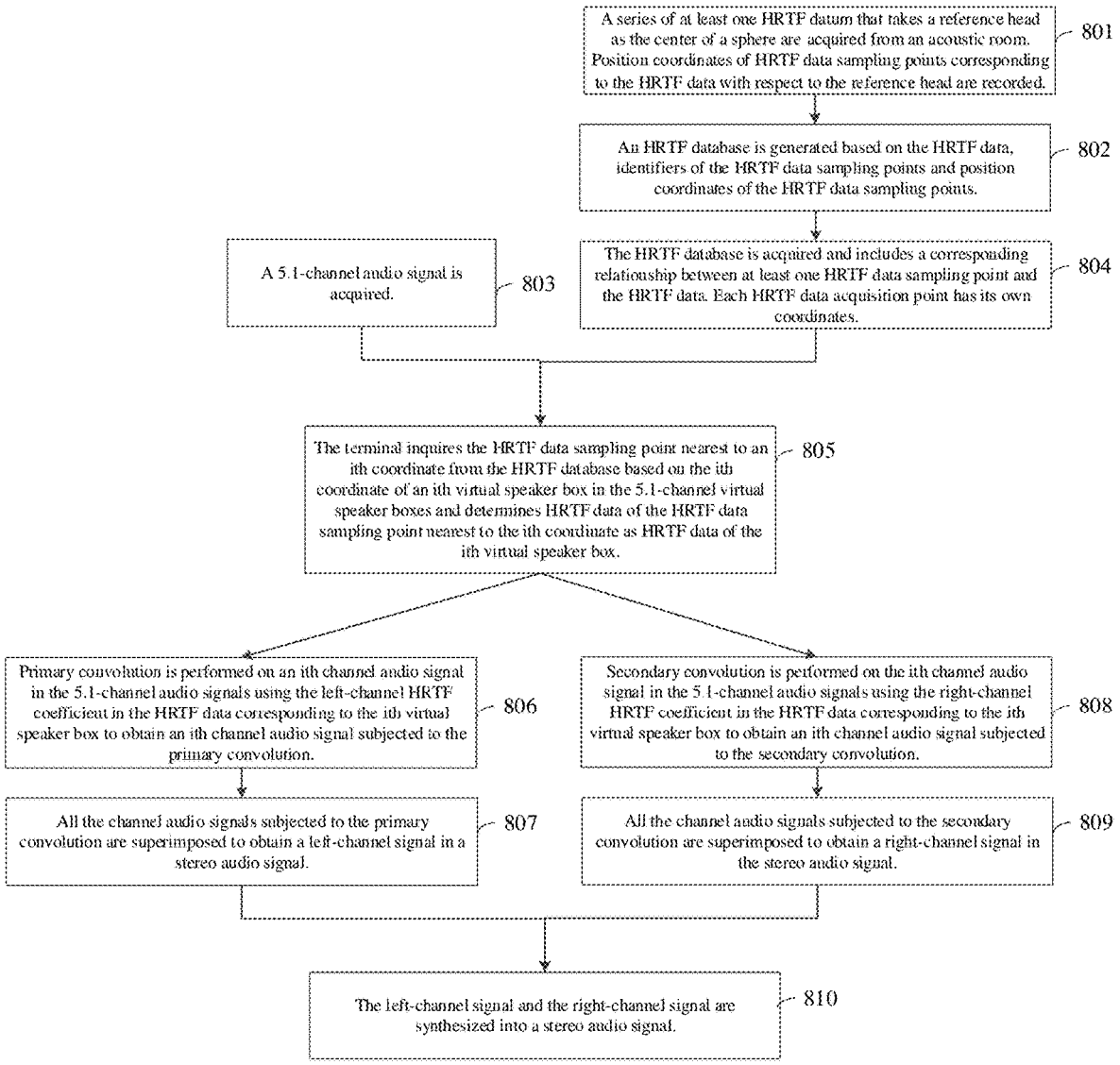
FIG. 8 is a flowchart of an audio signal processing method in accordance with an exemplary embodiment of the present disclosure.

In the embodiment illustrated in FIG. 1, the process in which the first stereo audio signal is split into the 5.1-channel audio signals is divided into two stages. In the first stage, a 5.0-channel audio signal in the 5.1-channel audio signals is acquired, and the embodiments illustrated in FIG. 2, FIG. 3 and FIG. 4 may explain splitting of the 5.0-channel audio signal from the first stereo audio signal. In the second stage, a 0.1-channel audio signal in the 5.1-channel audio signals is acquired, and the embodiment illustrated in FIG. 5 may explain splitting of the 0.1-channel audio signal from the first stereo audio signal. In the third stage, the 5.0-channel audio signal and the 0.1-channel audio signal are synthesized into the second stereo audio signal. The embodiments illustrated in FIG. 6 and FIG. 8 provide methods for processing and synthesizing the 5.1-channel audio signals to obtain the second stereo audio signal.

Figure 2:
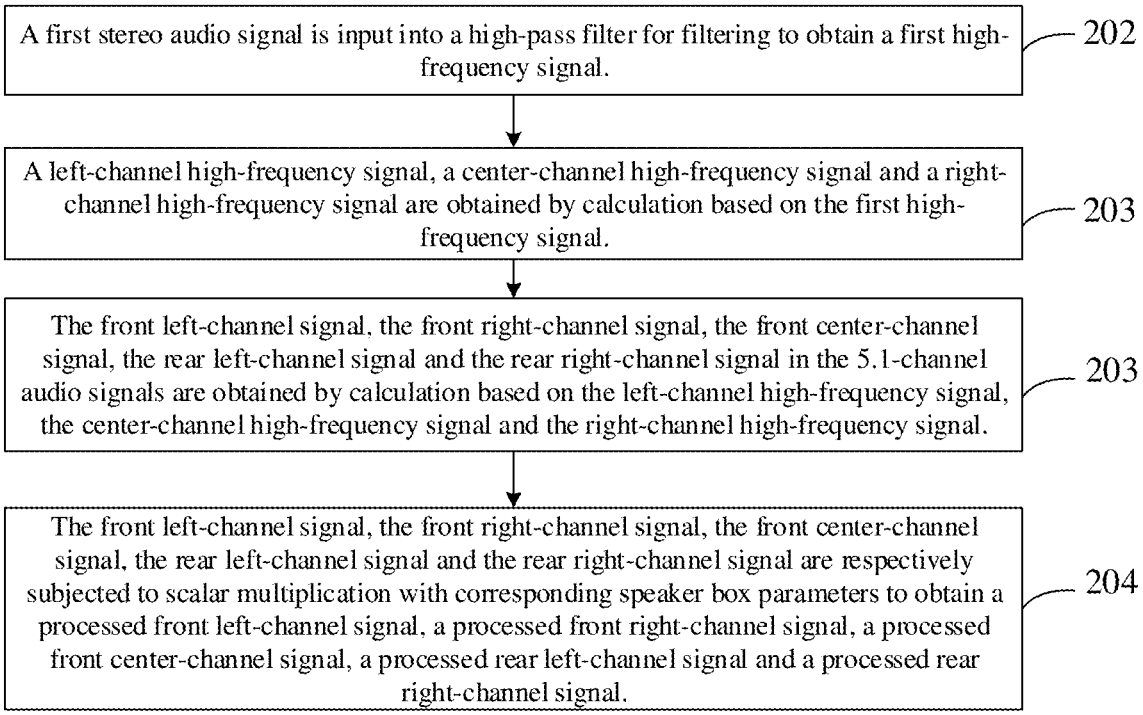
FIG. 2 is a flowchart of an audio signal processing method in accordance with an exemplary embodiment of the present disclosure.

FIG. 2 is a flowchart of an audio signal processing method in accordance with an exemplary embodiment of the present disclosure. The method may be performed by a terminal with an audio signal processing function and may be an optional implementation mode of step 102 and step 103 in the embodiment illustrated in FIG. 1. The method includes the following steps.

In step 201, a first stereo audio signal is input into a high-pass filter for filtering to obtain a first high-frequency signal.

The terminal inputs the first stereo audio signal into the high-pass filter for filtering to obtain the first high-frequency signal. The first high-frequency signal is a superimposed signal of a first left-channel high-frequency signal and a first right-channel high-frequency signal.

Optionally, the terminal filters the first stereo signal by a 4-order IIR high-pass filter to obtain the first high-frequency signal.

In step 202, a left-channel high-frequency signal, a center-channel high-frequency signal and a right-channel high-frequency signal are obtained by calculation based on the first high-frequency signal.

The terminal splits the first high-frequency signal into the left-channel high-frequency signal, the center-channel high-frequency signal and the right-channel high-frequency signal. The left-channel high-frequency signal includes a front left-channel signal and a rear left-channel signal. The center-channel high-frequency signal includes a front center-channel signal. The right-channel high-frequency signal includes a front right-channel signal and a rear right-channel signal.

Optionally, the terminal obtains the center-channel high-frequency signal by calculation based on the first high-frequency signal. The center-channel high-frequency signal is subtracted from the first left-channel high-frequency signal to obtain the left-channel high-frequency signal. The center-channel high-frequency signal is subtracted from the first right-channel high-frequency signal to obtain the right-channel high-frequency signal.

In step 203, the front left-channel signal, the front right-channel signal, the front center-channel signal, the rear left-channel signal and the rear right-channel signal in the 5.1-channel audio signals are obtained by calculation based on the left-channel high-frequency signal, the center-channel high-frequency signal and the right-channel high-frequency signal.

The terminal obtains the front left-channel signal and the rear left-channel signal by calculation based on the left-channel high-frequency signal, obtains the front right-channel signal and the rear right-channel signal by calculation based on the right-channel high-frequency signal, and obtains the front center-channel signal by calculation based on the center-channel high-frequency signal.

Optionally, the terminal extracts first rear/reverberation signal data in the left-channel high-frequency signal, second rear/reverberation signal data in the center-channel high-frequency signal and third rear/reverberation signal data in the right-channel high-frequency signal, and calculates the front left-channel signal, the rear left-channel signal, the front right-channel signal, the rear right-channel signal and the front center-channel signal based on the first rear/reverberation signal data, the second rear/reverberation signal data and the third rear/reverberation signal data.

In step 204, the front left-channel signal, the front right-channel signal, the front center-channel signal, the rear left-channel signal and the rear right-channel signal are respectively subjected to scalar multiplication with corresponding speaker box parameters to obtain a processed front left-channel signal, a processed front right-channel signal, a processed front center-channel signal, a processed rear left-channel signal and a processed rear right-channel signal.

Optionally, the terminal performs scalar multiplication on the front left-channel signal and a volume V1 of a virtual front left-channel speaker box to obtain the processed front left-channel signal X_FL, on the front right-channel signal and a volume V2 of a virtual front right-channel speaker box to obtain the processed front right-channel signal X_FR, on the front center-channel signal and a volume V3 of a virtual front center-channel speaker box to obtain the processed front center-channel signal X_FC, on the rear left-channel signal and a volume V4 of a virtual rear left-channel speaker box to obtain the processed rear left-channel signal X_RL, and on the rear right-channel signal and a volume V5 of a virtual rear right-channel speaker box to obtain the processed rear right-channel signal X_RR.

In summary, according to the method provided by the embodiment, the first stereo audio signal is filtered to obtain the first high-frequency signal. The left-channel high-frequency signal, the center-channel high-frequency signal and the right-channel high-frequency signal are obtained by calculation based on the first high-frequency signal. The 5.0-channel audio signal is obtained by calculation based on the left-channel high-frequency signal, the center-channel high-frequency signal and the right-channel high-frequency signal to further obtain the processed 5.0-channel audio signal. Thus, the first high-frequency signal is extracted from the first stereo audio signal and split into the 5.0-channel audio signal in the 5.1-channel audio signals to further obtain the processed 5.0-channel audio signal.

Figure 3:
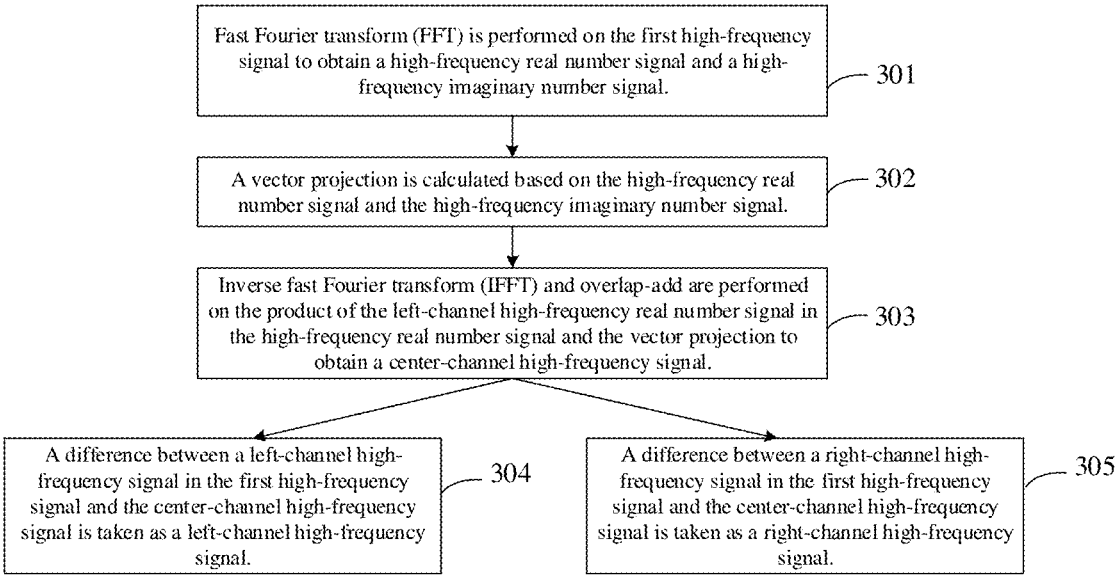
FIG. 3 is a flowchart of an audio signal processing method in accordance with an exemplary embodiment of the present disclosure.

FIG. 3 is a flowchart of an audio signal processing method in accordance with an exemplary embodiment of the present disclosure. The audio signal processing method is applied to a terminal with an audio signal processing function and may be an optional implementation mode of step 202 in the embodiment illustrated in FIG. 2. The method includes the following steps.

In step 301, fast Fourier transform (FFT) is performed on the first high-frequency signal to obtain a high-frequency real number signal and a high-frequency imaginary number signal.

The terminal performs FFT on the first high-frequency signal to obtain the high-frequency real number signal and the high-frequency imaginary number signal.

FFT is an algorithm for transforming a time-domain signal into a frequency-domain signal. In the present embodiment, the first high-frequency signal is subjected to FFT to obtain the high-frequency real number signal and the high-frequency imaginary number signal. The high-frequency real number signal includes a left-channel high-frequency real number signal and a right-channel high-frequency real number signal. The high-frequency imaginary number signal includes a left-channel high-frequency imaginary number signal and a right-channel high-frequency imaginary number signal.

In step 302, a vector projection is calculated based on the high-frequency real number signal and the high-frequency imaginary number signal.

The terminal obtains a high-frequency real number signal by adding the right-channel high-frequency real number signal to the left-channel high-frequency real number signal in the high-frequency real number signal.

Exemplarily, the high-frequency real number signal is calculated by the following formula:

$$\text{sum}RE = X_\text{HIPASS}_RE_L + X_\text{HIPASS}_RE_R$$

X_HIPASS_RE_L is the left-channel high-frequency real number signal, X_HIPASS_RE_R is the right-channel high-frequency real number signal and sumRE is the high-frequency real number signal.

The terminal obtains a high-frequency imaginary number summary signal by adding the right-channel high-frequency imaginary number signal to the left-channel high-frequency imaginary number signal in the high-frequency imaginary number signal.

Exemplarily, the high-frequency imaginary number summary signal is calculated by the following formula:

$$\text{sum}IM = X_\text{HIPASS}_IM_L + X_\text{HIPASS}_IM_R$$

X_HIPASS_IM_L is the left-channel high-frequency imaginary number signal, X_HIPASS_IM_R is the right-channel high-frequency imaginary number signal and sumIM is the high-frequency imaginary number signal.

The terminal performs subtraction on the left-channel high-frequency real number signal and the right-channel high-frequency real number signal in the high-frequency real number signal to obtain a high-frequency real number difference signal.

Exemplarily, the high-frequency real number difference signal is calculated by the following formula:

$$\text{differ} = X_\text{HIPASS}_RE_L - X_\text{HIPASS}_RE_R$$

diffRE is the high-frequency real number difference signal.

The terminal performs subtraction on the left-channel high-frequency imaginary number signal and the right-channel high-frequency imaginary number signal in the high-frequency imaginary number signal to obtain a high-frequency imaginary number difference signal.

Exemplarily, the high-frequency imaginary number difference signal is calculated by the following formula:

$$\text{diff}IM=X_\text{HIPASS}_IM_L-X_\text{HIPASS}_IM_R$$

diffIM is the high-frequency imaginary number difference signal.

The terminal obtains a real number signal by calculation based on the high-frequency real number signal and the high-frequency imaginary number signal.

Exemplarily, the real number summary signal is calculated by the following formula:

$$\text{sum}Sq=\text{sum}RE*\text{sum}RE+\text{sum}IM*\text{sum}IM$$

sumSq is the real number signal.

The terminal obtains a real number difference signal based on a high-frequency real number difference signal and a high-frequency imaginary number difference signal.

Exemplarily, the real number difference signal is calculated by the following formula:

$$\text{diff}Sq=\text{diff}RE*\text{diff}RE+\text{diff}IM*\text{diff}IM$$

diffSq is the real difference signal.

The terminal calculates the vector projection based on the real number signal and the real number difference signal to obtain the vector projection that represents a distance between each virtual speaker box in the three-dimensional surround 5.1-channel virtual speaker box and the user.

Optionally, the vector protection is calculated by the following formula when the real number signal is a significant digit. That is, the vector protection is calculated by the following formula when the real number signal is not infinitely small or 0:

$$\text{Alpha}=0.5-\text{SQRT}(\text{diff}Sq/\text{sum}Sq)*0.5$$

alpha is the vector projection, SQRT represents extraction of square root and * represents a scalar product.

In step 303, inverse fast Fourier transform (IFFT) and overlap-add are performed on the product of the left-channel high-frequency real number signal in the high-frequency real number signal and the vector projection to obtain a center-channel high-frequency signal.

IFFT is an algorithm for transforming a frequency-domain signal into a time-domain signal. In the present disclosure, the terminal performs IFFT and overlap-add on the product of the left-channel high-frequency real number signal in the high-frequency real number signal and the vector projection to obtain the center-channel high-frequency signal. Referring to https://en.wikipedia.org/wiki/Overlap-add_method for details of the overlap-add which is a mathematical algorithm. The center-channel high-frequency signal may be calculated based on the left-channel high-frequency real number signal or the right-channel high-frequency real number signal. However, since most audio signals are gathered at a left channel if the first stereo signal only includes an audio signal of one channel, the center high-frequency signal may be calculated more accurately based on the left-channel high-frequency real number signal.

In step 304, a difference between a left-channel high-frequency signal in the first high-frequency signal and the center-channel signal is taken as a left-channel high-frequency signal.

The terminals take the difference between the left-channel high-frequency signal in the first high-frequency signal and the center-channel signal as the left-channel high-frequency signal.

Exemplarily, the left-channel high-frequency signal is calculated by the following formula:

$$X_\text{PRE}_L=X_\text{HIPASS}_L-X_\text{PRE}_C$$

X_HIPASS_L is the left-channel high-frequency signal in the first high-frequency signal, X_PRE_C is the center-channel signal, and X_PRE_L is the left-channel high-frequency signal.

In step 305, a difference between a right-channel high-frequency signal in the first high-frequency signal and the center-channel signal is taken as a right-channel high-frequency signal.

The terminal takes the difference between the right-channel high-frequency signal in the first high-frequency signal and the center-channel signal as the right-channel high-frequency signal.

Exemplarily, the right-channel high-frequency signal is calculated by the following formula:

$$X_\text{PRE}_R=X_\text{HIPASS}_R-X_\text{PRE}_C$$

X_HIPASS_R is the right-channel high-frequency signal in the first high-frequency signal, X_PRE_C is the center-channel signal and X_PRE_R is the right-channel high-frequency signal.

The sequence of step 304 and step 305 is not limited. The terminal may perform step 304 prior to step 305, or perform step 305 prior to step 304.

In summary, according to the method provided by the embodiment, FFT is performed on the first high-frequency signal to obtain the high-frequency real number signal and the high-frequency imaginary number signal. The center high-frequency signal is obtained by a series of calculations based on the high-frequency real number signal and the high-frequency imaginary number signal. Further, the left-channel high-frequency signal and the right-channel high-frequency signal are obtained by calculation based on the center-channel high-frequency signal. Thus, the left-channel high-frequency signal, the center high-frequency signal and the right-channel high-frequency signal are obtained by calculation based on the first high-frequency signal.

Figure 4:
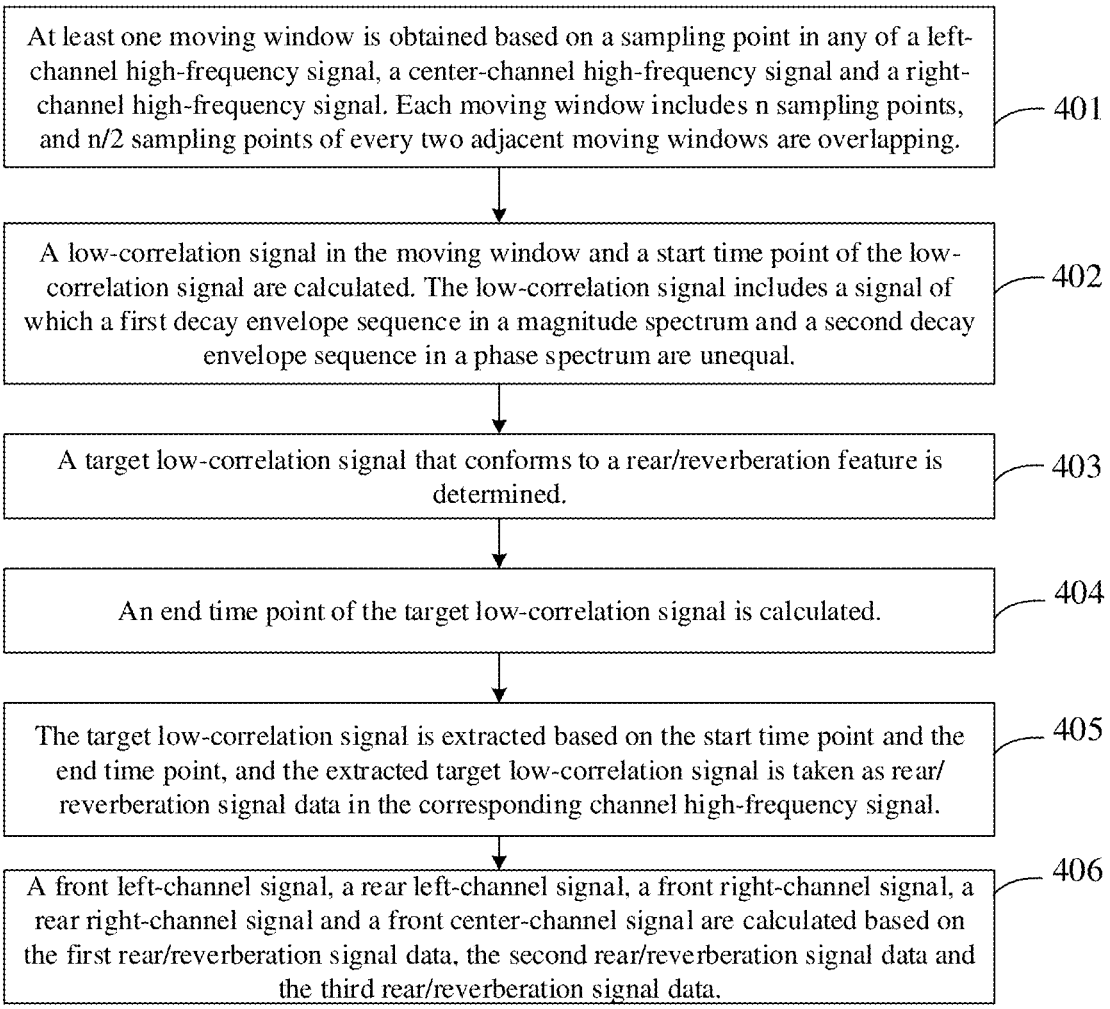
FIG. 4 is a flowchart of an audio signal processing method in accordance with an exemplary embodiment of the present disclosure.

FIG. 4 is a flowchart of an audio signal processing method in accordance with an exemplary embodiment of the present disclosure. The audio signal processing method may be performed by a terminal with an audio signal processing function and may be an optional implementation mode of step 203 in the embodiment illustrated in FIG. 2. The method includes the following steps.

In step 401, at least one moving window is obtained based on a sampling point in any of a left-channel high-frequency signal, a center-channel high-frequency signal and a right-channel high-frequency signal. Each moving window includes n sampling points, and n/2 sampling points of every two adjacent moving windows are overlapping.

The terminal obtains at least one moving window based on the sampling point in any of the left-channel high-frequency signal, the center-channel high-frequency signal and the right-channel high-frequency signal by a moving window algorithm. If each moving window has n sampling points, n/2 sampling points of every two adjacent moving windows are overlapping, and $n \geq 1$.

The moving window is an algorithm similar to overlap-add, and it realizes only overlap but not addition. For example, data A include 1,024 sampling points, if a moving step length is 128 and an overlap length is 64, the following signals are output by the moving window every time: A[0-128] output firstly, A[64-192] output secondly, A[128-256] output thirdly, . . . . A is the moving window, and a serial number of the sampling point is inside the square brackets.

In step 402, a low-correlation signal in the moving window and a start time point of the low-correlation signal are calculated. The low-correlation signal includes a signal of which a first decay envelope sequence in a magnitude spectrum and a second decay envelope sequence in a phase spectrum are unequal.

The terminal performs FFT on a sampling point signal in an $i^{th}$ moving window to obtain a sampling point signal subjected to FFT, and $i \geq 1$.

The terminal performs the moving window algorithm and FFT on the left-channel high-frequency signal, the right-channel high-frequency signal and the center-channel signal respectively based on a preset moving step length and overlap length to sequentially obtain a left-channel high-frequency real number signal and a left-channel high-frequency imaginary number signal (denoted as FFT_L), a right-channel high-frequency real number signal and a right-channel high-frequency imaginary number signal (denoted as FFT_R), and a center-channel real number signal and a center-channel imaginary number signal (denoted as FFT_C).

The terminal calculates a magnitude spectrum and a phase spectrum of the sampling point signal subjected to FFT.

The terminal calculates a magnitude spectrum AMP_L and a phase spectrum PH_L of the left-channel high-frequency signal based on FFT_L, calculates a magnitude spectrum AMP_R and a phase spectrum PH_R of the left-channel high-frequency signal based on FFT_R and calculates a magnitude spectrum AMP_C and a phase spectrum PH_C of the center-channel signal.

In the followings, AMP_L, AMP_R and AMP_C are denoted as AMP_L/R/C, and PH_L, PH_R and PH_C are denoted as PH_L/R/C.

The terminal calculates a first decay envelope sequence of m frequency lines in the $i^{th}$ moving window based on the magnitude spectrum of the sampling point signal subjected to FFT, calculates a second decay envelope sequence of the m frequency lines in the $i^{th}$ moving window based on the phase spectrum of the sampling point signal subjected to FFT, determines a $j^{th}$ frequency line as the low-correlation signal when the decay envelope sequence and the second decay envelope sequence of the $j^{th}$ frequency line in the m frequency lines are different, and determines a start time point of the low-correlation signal based on a window number of the $i^{th}$ moving window and a frequency line number of the $j^{th}$ frequency line, wherein $m \geq 1$ and $1 \leq j \leq m$.

The terminal calculates the decay envelope sequences and relevancy of all the frequency lines for AMP_L/R/C and PH_L/R/C of all the moving windows. An effective condition is that the calculated decay envelope sequence of the moving window corresponds to the magnitude spectrum and the phase spectrum of the same moving window.

For example, when the decay envelope sequences of frequency spectra of No. 0 frequency lines corresponding to a moving window 1, a moving window 2 and a moving window 3 are respectively 1.0, 0.8 and 0.6, and the decay envelope sequences of phase spectrums of No. 0 frequency lines corresponding to the moving window 1, the moving window 3 and the moving window 3 are respectively 1.0, 0.8 and 1.0, it is believed that the No. 0 frequency line of the moving window 1 and the No. 0 frequency line of the moving window 2 are highly relevant, and the No. 0 frequency line of the moving window 2 and the No. 0 frequency line of the moving window 3 are less relevant.

The n sampling points may be subjected to FFT to obtain n/2+1 frequency lines. A window number and the frequency lines of a moving window corresponding to a signal with low correlation are taken. The start time point of the signal in X_PRE_L, X_PRE_R and X_PRE_C may be calculated based on the window number.

In step 403, a target low-correlation signal that conforms to a rear/reverberation feature is determined.

Optionally, the terminal determines the target low-correlation signal that conforms to the rear/reverberation feature by the following means.

When magnitude spectrum energy of a very high frequency (VHF) line of the low-correlation signal is less than a first threshold and a decay envelope slope of a window adjacent to a window where the VHF line is greater than a second threshold, the terminal determines the low-correlation signal as the target low-correlation signal that conforms to the rear/reverberation feature. The VHF line is a frequency line of which a frequency band ranges from 30 MHz to 300 MHz.

Optionally, a method by which the terminal determines the target low-correlation signal that conforms to the rear/reverberation feature may include but not limited to the following steps.

When the magnitude spectrum energy of the VHF line of the low-correlation signal is smaller than the first threshold and a decay rate of a window adjacent to a window where the VHF line is larger than a third threshold, the terminal determines the low-correlation signal as the target low-correlation signal that conforms to the rear/reverberation feature.

In step 404, an end time point of the target low-correlation signal is calculated.

Optionally, the terminal calculates the end time point of the low-correlation signal by the following means.

The terminal acquires a time point at which energy of a frequency line corresponding to the magnitude spectrum of the target low-correlation signal is smaller than a fourth threshold and uses the acquired time point as the end time point.

Optionally, the terminal calculates the end time point of the low-correlation signal by the following means.

The terminal determines a start time point of the next low-correlation signal as the end time point of the target low-correlation signal when energy of the target low-correlation signal is smaller than 1/n of energy of the next low-correlation signal.

In step 405, the target low-correlation signal is extracted based on the start time point and the end time point, and the extracted target low-correlation signal is taken as rear/reverberation signal data in the corresponding channel high-frequency signal.

Optionally, the terminal extracts channel signal segments in the start time point and the end time point, performs FFT on the channel signal segments to obtain signal segments subjected to FFT, extracts a frequency line corresponding to the target low-correlation signal from the signal segments subjected to FFT to obtain a first portion signal, and performs IFFT and overlap-add on the first portion to obtain the rear/reverberation signal data in the corresponding channel high-frequency signal.

By the above steps, the terminal obtains first rear/reverberation signal data in the left-channel high-frequency signal, second rear/reverberation signal data in the center-channel high-frequency signal and third rear/reverberation signal data in the channel-channel high-frequency signal.

In step 406, a front left-channel signal, a rear left-channel signal, a front right-channel signal, a rear right-channel signal and a front center-channel signal are calculated based on the first rear/reverberation signal data, the second rear/reverberation signal data and the third rear/reverberation signal data.

The terminal determines a difference between the left-channel high-frequency signal and the first rear/reverberation signal data acquired in the above step as the front left-channel signal.

The first rear/reverberation signal data is audio data included in the left-channel high-frequency signal and is audio data included in the rear left-channel signal of a three-dimensional surround 5.1-channel virtual speaker. The left-channel high-frequency signal includes the front left-channel signal and part of the rear left-channel signal. Thus, the front left-channel signal may be obtained by subtracting the part of the rear left-channel signal, namely, the first rear/reverberation signal data, from the left-channel high-frequency signal.

The terminal determines the sum of the first rear/reverberation signal data and the second rear/reverberation signal data, which are acquired in the above step, as the rear left-channel signal.

The terminal determines a difference between the right-channel high-frequency signal and the third rear/reverberation signal data acquired in the above step as the front right-channel signal.

The third rear/reverberation signal data is audio data included in the right-channel high-frequency signal and is audio data included in the rear right-channel signal of the three-dimensional surround 5.1-channel virtual speaker. The right-channel high-frequency signal includes the front right-channel signal and part of the rear right-channel signal. Thus, the front right-channel signal may be obtained by subtracting the part of the rear right-channel signal, namely, the third rear/reverberation signal data, from the right-channel high-frequency signal.

The terminal determines the sum of the third rear/reverberation signal data and the second rear/reverberation signal data, which are acquired in the above step, as the rear right-channel signal.

The terminal determines a difference between the center-channel high-frequency signal and the second rear/reverberation signal data acquired in the above step as the front center-channel signal.

The second rear/reverberation signal data is audio data included in the rear left-channel signal of the three-dimensional surround 5.1-channel virtual speaker box and is audio data included in the rear right-channel signal. The center-channel high-frequency signal includes the front center-channel signal and the second rear/reverberation signal data. Thus, the second rear/reverberation signal data may be subtracted from the center-channel high-frequency signal.

In summary, according to the method according to this embodiment, the rear/reverberation signal data in each channel high-frequency signal is extracted by calculating the start time and the end time of the rear/reverberation signal data in each channel high-frequency signal. The front left-channel signal, the rear left-channel signal, the front right-channel signal, the rear right-channel signal and the front center-channel signal are obtained by calculation based on the rear/reverberation signal data in each channel high-frequency signal. Thus, the accuracy is improved in obtaining the 5.1-channel audio signals by calculation based on the left-channel high-frequency signal, the center-channel high-frequency signal and the right-channel high-frequency signal.

Figure 5:
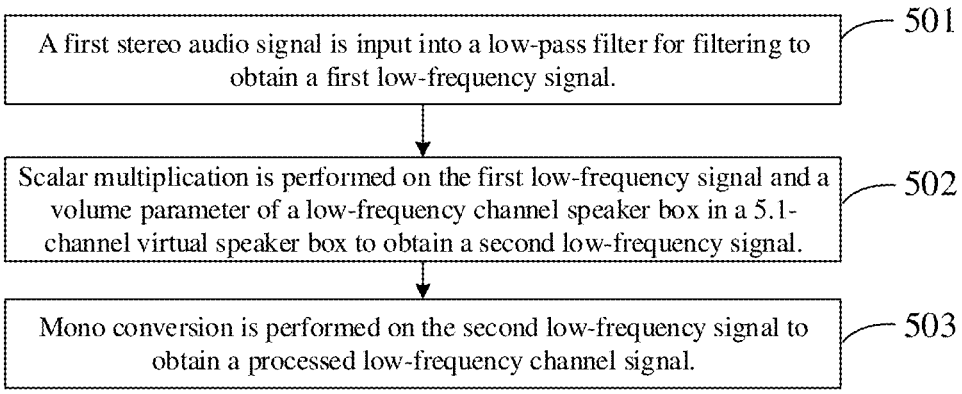
FIG. 5 is a flowchart of an audio signal processing method in accordance with an exemplary embodiment of the present disclosure.
Figure 6:
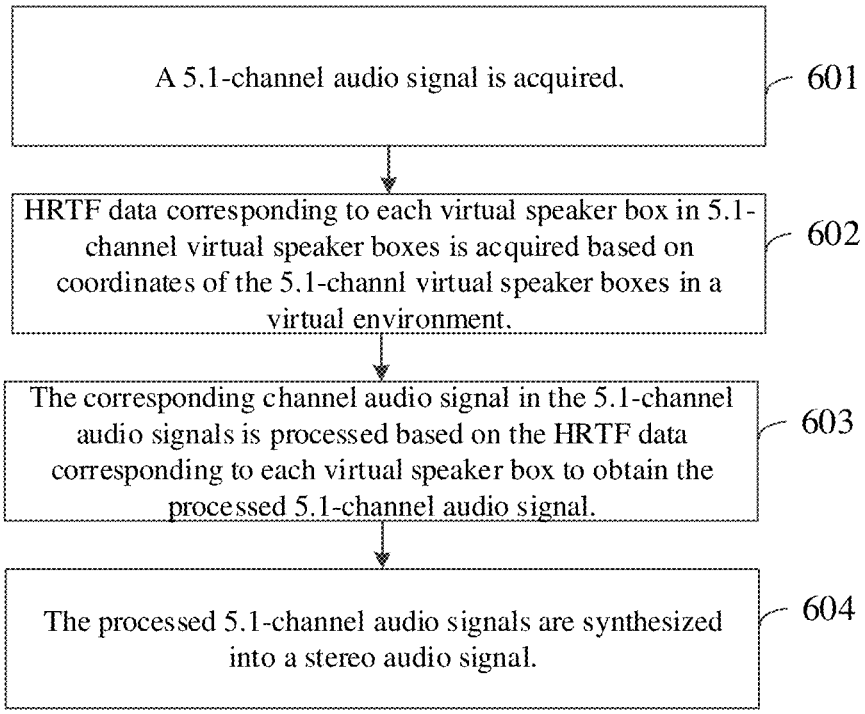
FIG. 6 is a flowchart of an audio signal processing method in accordance with an exemplary embodiment of the present disclosure.

FIG. 5 is a flowchart of an audio signal processing method in accordance with an exemplary embodiment of the present disclosure. The audio signal processing method may be performed by a terminal with an audio signal processing function and may be an optional embodiment of step 102 in the embodiment illustrated in FIG. 1. The method includes the following steps.

In step 501, a first stereo audio signal is input into a low-pass filter for filtering to obtain a first low-frequency signal.

The terminal inputs the first stereo audio signal into the low-pass filter for filtering to obtain the first low-frequency signal. The first low-frequency signal is a superimposed signal of a first left-channel low-frequency signal and a first right-channel low-frequency signal.

Optionally, the terminal filters the first stereo by a 4-order IIR low-pass filter to obtain the first low-frequency signal.

In step 502, scalar multiplication is performed on the first low-frequency signal and a volume parameter of a low-frequency channel speaker box in a 5.1-channel virtual speaker box to obtain a second low-frequency signal.

The terminal performs the scalar multiplication on the first low-frequency signal and the volume parameter of the low-frequency channel speaker box in the 5.1-channel virtual speaker box to obtain the second low-frequency signal.

Exemplarily, the terminal calculates the second low-frequency signal by the following formula:

$$X_LFE_S = X_LFE * V6$$

X_LFE is the first stereo low-frequency signal, V6 is the volume parameter of the low-frequency channel speaker box in the 5.1-channel virtual speaker box, X_LFE_S is the second low-frequency signal which is the superimposed signal of the first left-channel low-frequency signal X_LFE_S_L and the first right-channel low-frequency signal X_LFE_S_R, and * represents the scalar multiplication.

In step 503, mono conversion is performed on the second low-frequency signal to obtain a processed low-frequency channel signal.

The terminal performs mono conversion on the second low-frequency signal to obtain the processed low-frequency channel signal.

Exemplarily, the terminal calculates the processed low-frequency channel signal by the following formula:

$$X_LFE_M = (X_LFE_S_L + X_LFE_S_R)/2$$

X_LFE_M is the processed low-frequency channel signal.

In summary, according to the method provided by the embodiment, the first stereo audio signal is filtered to obtain the first low-frequency signal. Mono conversion is performed on the first low-frequency signal to obtain the low-frequency channel signal in 5.1-channel audio signals. Thus, the first low-frequency signal is extracted from the first stereo signal and split into a 0.1-channel audio signal in the 5.1-channel audio signals.

In the method embodiments mentioned above, the first stereo audio signal is split and processed to obtain the 5.1-channel audio signals, including the front left-channel signal, the front right-channel signal, the front center-channel signal, the low-frequency channel signal, the rear left-channel signal and the rear right-channel signal. The following embodiment illustrated in FIG. 6 and FIG. 8 provides a method by which the 5.1-channel audio signals are processed and synthesized to obtain a second stereo audio signal. The method may be an optional embodiment of step 104 in the embodiment illustrated in FIG. 1 and may also be an independent embodiment. A stereo signal obtained in the embodiments illustrated in FIG. 6 and FIG. 8 may be the second stereo audio signal in the above method embodiments.

The head related transfer function (HRTF) processing technology is a processing technology for producing a stereo surround sound effect. A technician may pre-establish an HRTF database, in which HRTF data, an HRTF data sampling point and a corresponding relationship between the HRTF data sampling point and position coordinates of a reference head are recorded. The HRTF data is a group of parameters for processing a left-channel audio signal and a right-channel audio signal.

FIG. 6 is a flowchart of an audio signal processing method in accordance with an exemplary embodiment of the present disclosure. The audio signal processing method may be performed by a terminal with an audio signal processing function and may be an optional embodiment of step 104 of the embodiment illustrated in FIG. 1. The method includes the following steps.

In step 601, a 5.1-channel audio signal is acquired.

Optionally, the 5.1-channel audio signal is the processed 5.1-channel audio signal which is obtained by splitting and processing the first stereo audio signal in the embodiment illustrated in FIGS. 1 to 5. Alternatively, the 5.1-channel audio signal is a 5.1-channel audio signal that is downloaded or read from a storage medium.

The 5.1-channel audio signal includes a front left-channel signal, a front right-channel signal, a front center-channel signal, a low-frequency channel signal, a rear left-channel signal and a rear right-channel signal.

In step 602, HRTF data corresponding to each virtual speaker box in 5.1-channel virtual speaker boxes is acquired based on coordinates of the 5.1-channel virtual speaker boxes in a virtual environment.

Optionally, the 5.1 virtual speaker boxes include a front left-channel virtual speaker box FL, a front right-channel virtual speaker box FR, a front center-channel virtual speaker box FC, a bass virtual speaker box LFE, a rear left-channel virtual speaker box RL and a rear right-channel virtual speaker box RR.

Optionally, the 5.1 virtual speaker boxes have their respective coordinates in the virtual environment that may be a two-dimensional planar virtual environment or a three-dimensional virtual planar environment.

Figure 7:
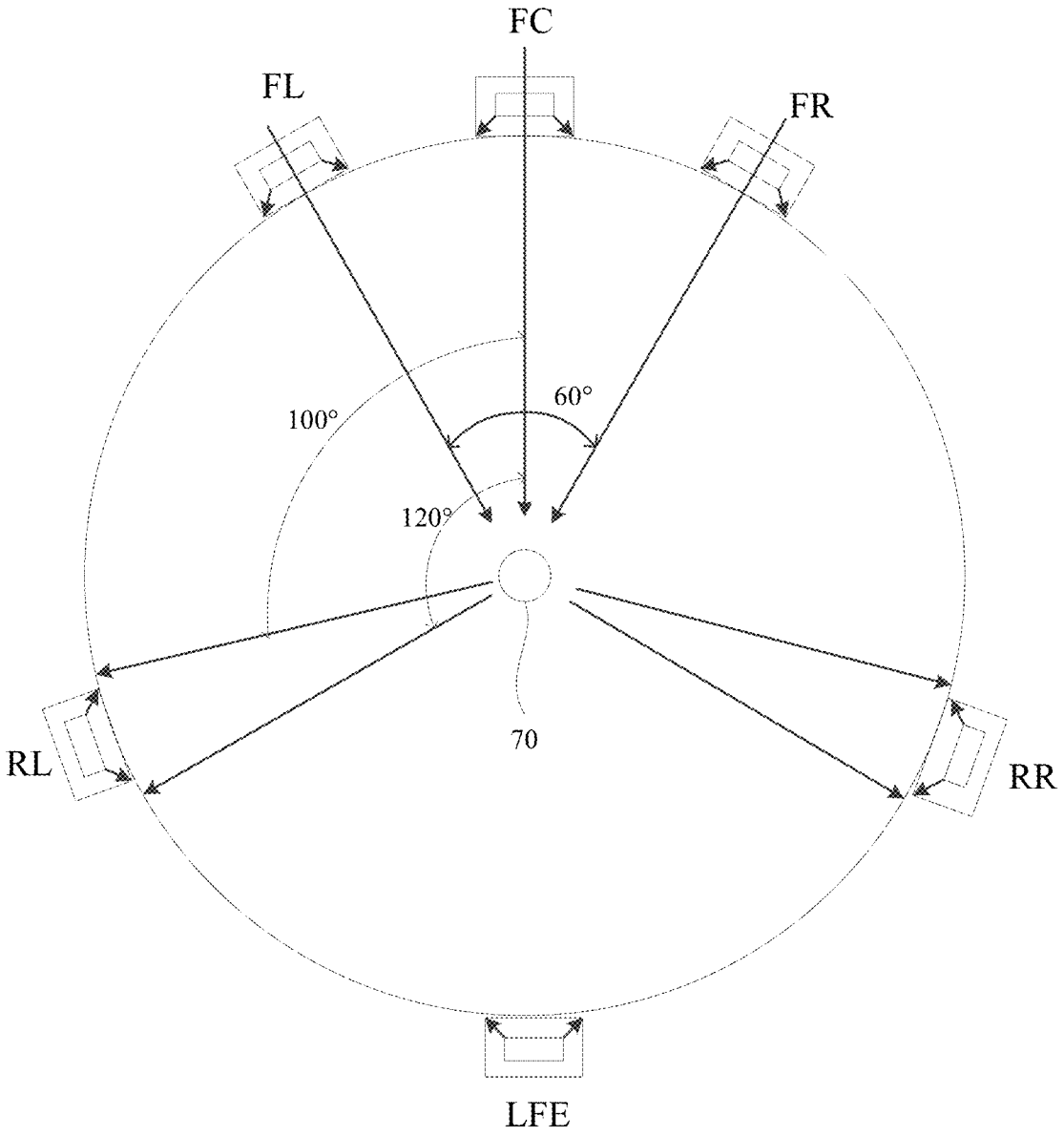
FIG. 7 is a schematic diagram showing placement of a 5.1-channel virtual speaker box in accordance with an exemplary embodiment of the present disclosure.

Exemplarily, referring to FIG. 7 which is a schematic diagram of a 5.1-channel virtual speaker box in a 2D planar virtual environment. It is assumed that the reference head is located at a central point 70 in FIG. 7 and faces towards the location of the center-channel virtual speaker box FC, and distances from all channels to the central point 70 where the reference head is located are the same, the channels and the central point are on the same plane.

A front center-channel virtual speaker box is located right ahead a direction that the reference head faces towards.

The front left-channel virtual speaker box FL and the front right-channel virtual speaker box FR are located at two sides of the front center-channel FC respectively, form an angle of 30° with the direction that the reference head faces towards respectively and are disposed symmetrically.

The rear left-channel virtual speaker box RL and the rear right-channel virtual speaker box RR are located behind two sides of the direction that the reference head faces towards respectively, form an angle of 100° to 120° with the direction that the reference head faces towards respectively and are disposed symmetrically.

Since the bass virtual speaker box LFE is relatively weaker in sense of direction, its locating place is not strictly required. In the text, a direction that the reference head faces away from is taken as an example for explanation. However, the angle formed by the bass virtual speaker box LFT and the direction that the reference head faces towards is not limited by the present disclosure.

It should be noted that the angle formed by each virtual speaker box in the 5.1-channel virtual speaker boxes and the direction that the reference head faces towards is merely exemplary. In addition, the distances between the virtual speaker boxes and the reference head may be different. When the virtual environment is a three-dimensional virtual environment, the virtual speaker boxes may be at different heights. Due to the different locating places of the virtual speaker boxes, sound signals may be different, which is not limited in the present disclosure.

Optionally, after a coordinate system is built for the two-dimensional virtual environment or the three-dimensional virtual environment by taking the reference head as an original point, coordinates of each virtual speaker box in the virtual environment may be obtained.

The HRTF database stored in the terminal includes a corresponding relationship between at least one HRTF data sampling point and the HRTF data. Each HRTF data sampling point has its own coordinates.

The terminal inquires the HRTF data sampling point nearest to an $i^{th}$ coordinate from the HRTF database based on an $i^{th}$ coordinate of an $i^{th}$ virtual speaker box in the 5.1-channel virtual speaker boxes and determines HRTF data of the HRTF data sampling point nearest to the $i^{th}$ coordinate as HRTF data of the $i^{th}$ virtual speaker box, and $i \geq 1$.

In step 603, the corresponding channel audio signal in the 5.1-channel audio signals is processed based on the HRTF data corresponding to each virtual speaker box to obtain the processed 5.1-channel audio signal.

Optionally, each piece of HRTF data includes a left-channel HRTF coefficient and a right-channel HRTF coefficient.

The terminal processes an $i^{th}$ channel audio signal in the 5.1-channel audio signals based on the left-channel HRTF coefficient in the HRTF data corresponding to the $i^{th}$ virtual speaker box to obtain a left-channel component corresponding to the processed $i^{th}$ channel audio signal.

The terminal processes the $i^{th}$ channel audio signal in the 5.1-channel audio signals based on the right-channel HRTF coefficient in the HRTF data corresponding to the $i^{th}$ virtual speaker box to obtain a right-channel component corresponding to the processed $i^{th}$ channel audio signal.

In step 604, the processed 5.1-channel audio signals are synthesized into a stereo audio signal.

It should be noted that when the 5.1-channel audio signals in the present embodiment are the processed 5.1-channel audio signals obtained by splitting and processing the first stereo audio signal in the embodiment illustrated in FIGS. 1 to 5, the stereo audio signal in this step is the second stereo audio signal in the embodiment illustrated in FIG. 1.

In summary, according to the method provided by the present embodiment, the 5.1-channel audio signals are processed based on the HRTF data of all the 5.1-channel virtual speaker boxes, and the processed 5.1-channel audio signals are synthesized into the stereo audio signal, such that a user can play the 5.1-channel audio signals only using a common stereo earphone or a 2.0 speaker box and may also enjoy a better tone quality.

FIG. 8 is a flowchart of an audio signal processing method in accordance with an exemplary embodiment. The audio signal processing method may be performed by a terminal with an audio signal processing function and may be an optional embodiment of step 104 in the embodiment illustrated in FIG. 1. The method includes the following steps.

In step 801, a series of at least one HRTF datum that takes a reference head as the center of a sphere are acquired from an acoustic room. Position coordinates of HRTF data sampling points corresponding to the HRTF data with respect to the reference head are recorded.

Figure 9:
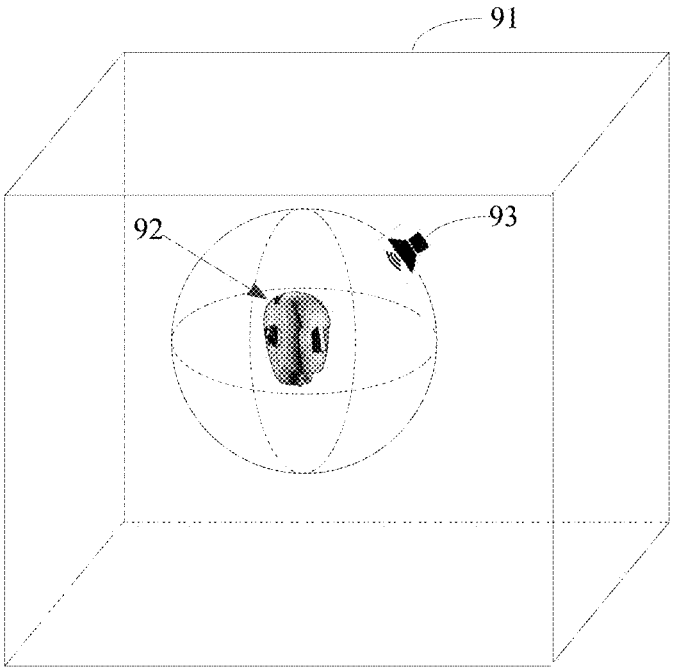
FIG. 9 is a schematic diagram showing HRTF data acquisition in accordance with an exemplary embodiment of the present disclosure.

Referring to FIG. 9, a developer places the reference head 92 (made by simulating a human head) in the center of the acoustic room 91 (sound-absorbing sponge is disposed at the periphery of the room to reduce interference of echoes) in advance and disposes miniature omni-directional microphones in a left ear canal and a right ear canal of the reference head 92 respectively.

After finishing disposing of the reference head 92, the developer disposes the HRTF data sampling points on the surface of a sphere that takes the reference head 92 as the center every preset distance and plays preset audios at the HRTF data sampling points by a speaker 93.

The distance between the left ear canal and the speaker 93 is different from that between the right ear canal and the speaker 93. The same audio has different audio features when reaching the left ear canal and the right ear canal because sound waves are affected by refraction, interference, diffraction, etc. Thus, the HRTF data at the HRTF data sampling points may be obtained by analyzing the difference between the audios acquired by the microphones and an original audio. The HRTF data corresponding to the same HRTF data sampling point includes a left-channel HRTF coefficient corresponding to a left channel and a right-channel HRTF coefficient corresponding to a right channel.

In step 802, an HRTF database is generated based on the HRTF data, identifiers of the HRTF data sampling points and position coordinates of the HRTF data sampling points.

Optionally, a coordinate system is built by taking the reference head 92 as a central point. The coordinate system is built in the same way as a coordinate system of a 5.1-channel virtual speaker box.

When a virtual environment corresponding to the 5.1-channel virtual speaker box is a 2D virtual environment, a coordinate system may only be built for a horizontal plane where the reference head 92 is during acquisition of the HRTF data, and only the HRTF data of the horizontal plane are acquired. For example, on a circular ring that takes the reference head 92 as the center, a point is taken every 5° as the HRTF data sampling point. At this time, the HRTF data volume required to be stored in the terminal may be reduced.

When the virtual environment corresponding to the 5.1-channel virtual speaker box is a three-dimensional virtual environment, a coordinate system may be built for the three-dimensional environment where the reference head 92 is during acquisition of the HRTF data, and the HRTF data on the surface of the sphere that takes the reference head 92 as the center are acquired. For example, on the surface of the sphere that takes the reference head 92 as the center, a point is taken every 5° in a longitude direction and a latitude direction as the HRTF data sampling point.

Then, the terminal produces the HRTF database based on an identifier of each HRTF data sampling point, HRTF data of each HRTF data sampling point and the position coordinate of each HRTF data sampling point.

It should be noted that step 801 and step 802 may also be performed and implemented by other devices. The generated HRTF database is transmitted to a current terminal by a network or a storage medium.

In step 803, a 5.1-channel audio signal is acquired.

Optionally, the terminal acquires the 5.1-channel audio signal.

The 5.1-channel audio signal is the processed 5.1-channel audio signal obtained by splitting and processing the first stereo audio signal in the embodiment illustrated in FIGS. 1 to 5. Alternatively, the 5.1-channel audio signal is a 5.1-channel audio signal that is downloaded or read from a storage medium.

The 5.1-channel audio signal includes a front left-channel signal X_FL, a front right-channel signal X_FC, a front center-channel signal X_FC, a low-frequency channel signal X_LFE_M, a rear left-channel signal X_RL and a rear right-channel signal X_RR.

In step 804, the HRTF database is acquired and includes a corresponding relationship between at least one HRTF data sampling point and the HRTF data. Each HRTF data acquisition point has its own coordinates.

The terminal may read the HRTF database that is stored locally, or access the HRTF database stored on the network.

In step 805, the terminal inquires the HRTF data sampling point nearest to an $i^{th}$ coordinate from the HRTF database based on the $i^{th}$ coordinate of an $i^{th}$ virtual speaker box in the 5.1-channel virtual speaker boxes and determines HRTF data of the HRTF data sampling point nearest to the $i^{th}$ coordinate as HRTF data of the $i^{th}$ virtual speaker box.

Optionally, the coordinates of each virtual speaker box in the 5.1-channel virtual speaker boxes are pre-stored in the terminal, and $i \geq 1$.

The terminal inquires the HRTF data acquisition point nearest to a first coordinate from the HRTF database based on the first coordinate of a front left-channel virtual speaker box, and determines the HRTF data of the HRTF data acquisition point nearest to the first coordinate as HRTF data of the front left-channel virtual speaker box.

The terminal inquires the HRTF data acquisition point nearest to a second coordinate from the HRTF database based on the second coordinate of a front right-channel virtual speaker box, and determines the HRTF data of the HRTF data acquisition point nearest to the second coordinate as HRTF data of the front right-channel virtual speaker box.

The terminal inquires the HRTF data acquisition point nearest to a third coordinate from the HRTF database based on the third coordinate of a front center-channel virtual speaker box, and determines the HRTF data of the HRTF data acquisition point nearest to the third coordinate as HRTF data of the front center-channel virtual speaker box.

The terminal inquires the HRTF data acquisition point nearest to a fourth coordinate from the HRTF database based on the fourth coordinate of a rear left-channel virtual speaker box, and determines the HRTF data of the HRTF data acquisition point nearest to the fourth coordinate as HRTF data of the rear left-channel virtual speaker box.

The terminal inquires the HRTF data acquisition point nearest to a fifth coordinate from the HRTF database based on the fifth coordinate of a rear right-channel virtual speaker box, and determines the HRTF data of the HRTF data acquisition point nearest to the fifth coordinate as HRTF data of the rear right-channel virtual speaker box.

The terminal inquires the HRTF data acquisition point nearest to a sixth coordinate from the HRTF database based on the sixth coordinate of a low-frequency virtual speaker box, and determines the HRTF data of the HRTF data acquisition point nearest to the sixth coordinate as HRTF data of the low-frequency virtual speaker box.

The phrase "nearest to" means that the coordinate of the virtual speaker box and the coordinate of the HRTF data acquisition point are the same or the distance therebetween is the shortest.

In step 806, primary convolution is performed on an $i^{th}$ channel audio signal in the 5.1-channel audio signals using the left-channel HRTF coefficient in the HRTF data corresponding to the $i^{th}$ virtual speaker box to obtain an $i^{th}$ channel audio signal subjected to the primary convolution.

When the $i^{th}$ channel audio signal in the 5.1-channel audio signals is set as X_i, Li=X_i*H_L_i, wherein * represents convolution, and H_L_i represents the left-channel HRTF coefficient in the HRTF data corresponding to the $i^{th}$ virtual speaker box.

In step 807, all the channel audio signals subjected to the primary convolution are superimposed to obtain a left-channel signal in a stereo audio signal.

The terminal superimposes 6 channel audio signals Li subjected to the primary convolution to obtain the left-channel signal L=L1+L2+L3+L4+L5+L6 in the stereo audio signal.

In step 808, secondary convolution is performed on the $i^{th}$ channel audio signal in the 5.1-channel audio signals using the right-channel HRTF coefficient in the HRTF data corresponding to the $i^{th}$ virtual speaker box to obtain an $i^{th}$ channel audio signal subjected to the secondary convolution.

When the $i^{th}$ channel audio signal in the 5.1-channel audio signals is set as X_i, Ri=X_i*H_R_i, wherein * represents convolution, and H_R_i represents the right-channel HRTF coefficient in the HRTF data corresponding to the $i^{th}$ virtual speaker box.

In step 809, all the channel audio signals subjected to the secondary convolution are superimposed to obtain a right-channel signal in the stereo audio signal.

The terminal superimposes 6 channel audio signals Ri subjected to the secondary convolution to obtain the right-channel signal R=R1+R2+R3+R4+R5+R6 in the stereo audio signal.

In step 810, the left-channel signal and the right-channel signal are synthesized into a stereo audio signal.

The synthesized stereo audio signal may be stored as an audio file or input into a playback device for playback.

It should be noted that when the 5.1-channel audio signal in the present embodiment is the processed 5.1-channel audio signal obtained by splitting and processing the first stereo audio signal in the embodiment illustrated in FIGS. 1 to 5, the stereo audio signal in this step is the second stereo audio signal in the embodiment illustrated in FIG. 1.

In summary, according to the method provided by the present embodiment, the 5.1-channel audio signals are processed based on the HRTF data of each 5.1-channel virtual speaker box, and the processed 5.1-channel audio signals are synthesized into the stereo audio signal. Thus, a user can play the 5.1-channel audio signals only by a common stereo earphone or a 2.0 speaker box and can enjoy a better playback tone quality.

In the method provided by the present embodiment, by convolution and superposition on the 5.1-channel audio signals based on the HRTF data of the 5.1-channel virtual speaker boxes, the stereo audio signal with a better three-dimensional surround sound effect may be obtained. The stereo audio signal has a better three-dimensional surround effect during playback.

Figure 10:
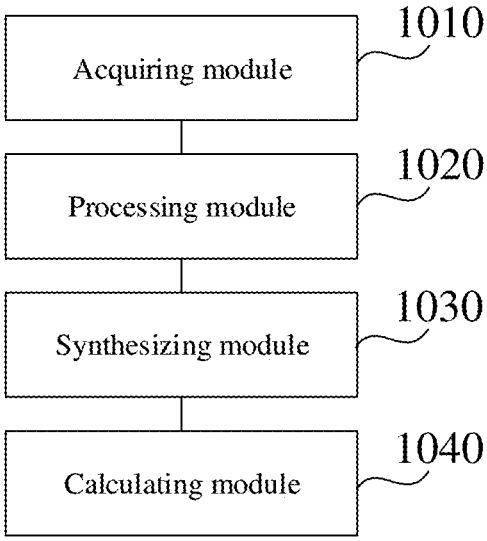
FIG. 10 is a block diagram of an audio signal processing apparatus in accordance with an exemplary embodiment of the present disclosure.

FIG. 10 is a structural block diagram of an audio signal processing apparatus in accordance with an exemplary embodiment of the present disclosure. The apparatus may be a terminal or part of the terminal, and includes:

an acquiring module 1010, configured to acquire a first stereo audio signal;

a processing module 1020, configured to split the first stereo audio signal into 5.1-channel audio signals and to process the 5.1-channel audio signals based on a speaker box parameter of a three-dimensional surround 5.1-channel virtual speaker box to obtain processed 5.1-channel audio signals; and a synthesizing module 1030, configured to synthesize the processed 5.1-channel audio signals into a second stereo audio signal.

In an optional embodiment, the apparatus further includes a calculation module 1040; and a processing module 1020, configured to input the first stereo audio signal into a high-pass filter for filtering to obtain a first high-frequency signal.

The calculating module 1040 is configured to: obtain a left-channel high-frequency signal, a center-channel high-frequency signal and a right-channel high-frequency signal by calculation based on the first high-frequency signal; and obtain a front left-channel signal, a front right-channel signal, a front center-channel signal, a low-frequency channel signal, a rear left-channel signal and a rear right-channel signal in the 5.1-channel audio signals by calculation based on the left-channel high-frequency signal, the center-channel high-frequency signal and the right-channel high-frequency signal.

In an optional embodiment, the calculating module 1040 is further configured to: perform FFT on the first high-frequency signal to obtain a high-frequency real number signal and a high-frequency imaginary number signal; calculate a vector projection based on the high-frequency real number signal and the high-frequency imaginary number signal; perform FFT on a product of a left-channel high-frequency real number signal in the high-frequency real number signal and the vector projection to obtain the center-channel high-frequency signal; take a difference between a left-channel high-frequency signal in the first high-frequency signal and the center-channel signal as the left-channel high-frequency signal; and take a difference between a right-channel high-frequency signal in the first high-frequency signal and the center-channel signal as the right-channel high-frequency signal.

The calculating module 1040 is further configured to: add the right-channel high-frequency real number signal to the left-channel high-frequency real number signal in the high-frequency real number signal to obtain a high-frequency real number signal; add the right-channel high-frequency imaginary number signal to the left-channel high-frequency imaginary number signal in the high-frequency imaginary number signal to obtain a high-frequency imaginary number signal; perform subtraction on the left-channel high-frequency real number signal and the right-channel high-frequency real number signal in the high-frequency real number signal to obtain a high-frequency real number difference signal; perform subtraction on the left-channel high-frequency imaginary number signal and the right-channel high-frequency imaginary number signal in the high-frequency imaginary number signal to obtain a high-frequency imaginary number difference signal; obtain a real number signal by calculation based on the high-frequency real number signal and the high-frequency imaginary number signal; obtain a real number difference signal based on the high-frequency real number difference signal and the high-frequency imaginary number difference signal; and calculate a vector projection based on the real number signal and the real number difference signal to obtain the vector projection.

In one optional embodiment, the calculating module 1040 is further configured to calculate the vector protection by the following formula when the real number signal is a significant digit:

$$alpha=0.5-SQRT(diffSQ/sumSQ)*0.5$$

alpha is the vector projection, diffSq is the real number difference signal, sumSQ is the real number signal, SQRT represents extraction of square root and * represents a scalar product.

In one optional embodiment:

the processing module 1020 is further configured to extract first rear/reverberation signal data in the left-channel high-frequency signal, second rear/reverberation signal data in the center-channel high-frequency signal and third rear/reverberation signal data in the right-channel high-frequency signal.

The calculating module 1040 is further configured to: determine a difference between the left-channel high-frequency signal and the first rear/reverberation signal data as the front left-channel signal; determine a sum of the first rear/reverberation signal data and the second rear/reverberation signal data as the rear left-channel signal; determine a difference between the right-channel high-frequency signal and the third rear/reverberation signal data as the front right-channel signal; determine a sum of the third rear/reverberation signal data and the second rear/reverberation signal data as the rear right-channel signal; and determine a difference between the center-channel high-frequency signal and the second rear/reverberation signal data as the front center-channel signal.

In one optional embodiment, the acquiring module 1010 is further configured to obtain at least one moving window based on a sampling point in any of the left-channel high-frequency signal, the center-channel high-frequency signal and the right-channel high-frequency signal. Each moving window includes n sampling points, and n/2 sampling points of every two adjacent moving windows are overlapping, $n \geq 1$.

The calculation module 1040 is further configured to: calculate a low-correlation signal in the moving window and a start time point of the low-correlation signal, wherein the low-correlation signal includes a signal of which a first decay envelope sequence in a magnitude spectrum and a second decay envelope sequence in a phase spectrum are unequal; determine a target low-correlation signal that conforms to a rear/reverberation feature; calculate an end time point of the target low-correlation signal; and extract the target low-correlation signal based on the start time point and the end time point, and take the extracted target low-correlation signal as rear/reverberation signal data in the corresponding channel high-frequency signal.

In one optional embodiment, the calculating module 1040 is further configured to: calculate a low-correlation signal in the moving window and a start time point of the low-correlation signal, wherein the low-correlation signal includes a signal of which a first decay envelope sequence in a magnitude spectrum and a second decay envelope sequence in a phase spectrum are unequal; determine a target low-correlation signal that conforms to a rear/reverberation feature; calculate an end time point of the target low-correlation signal; and extract the target low-correlation signal based on the start time point and the end time point, and take the extracted target low-correlation signal as rear/reverberation signal data in the corresponding channel high-frequency signal.

The calculating module 1040 is further configured to: perform FFT on a sampling point signal in an $i^{th}$ moving window to obtain a sampling point signal subjected to FFT; calculate a magnitude spectrum and a phase spectrum of the sampling point signal subjected to FFT; calculate a first decay envelope sequence of m frequency lines in the $i^{th}$ moving window based on a magnitude spectrum of the sampling point signal subjected to FFT; calculate a second decay envelope sequence of m frequency lines in the $i^{th}$ moving window based on a phase spectrum of the sampling point signal subjected to FFT; determine a $j^{th}$ frequency line as the low-correlation signal when the decay envelope sequence and the second decay envelope sequence of the $j^{th}$ frequency line in the m frequency lines are different; and determine a start time point of the low-correlation signal based on a window number of the $i^{th}$ moving window and a frequency line number of the $j^{th}$ frequency line, wherein $i \geq 1$, $m \geq 1$, $1 \leq j \leq m$.

In one optional embodiment, the calculating module 1040 is further configured to: when magnitude spectrum energy of a VHF line of the low-correlation signal is smaller than a first threshold and a decay envelope slope of a window adjacent to a window where the VHF line is is larger than a second threshold, determine the low-correlation signal as a target low-correlation signal that conforms to a rear/reverberation feature; or when the magnitude spectrum energy of the VHF line of the low-correlation signal is smaller than the first threshold and a decay rate of a window adjacent to a window where the VHF line is larger than a third threshold, determine the low-correlation signal as the target low-correlation signal that conforms to the rear/reverberation feature.

In one optional embodiment, the calculating module 1040 is further configured to: acquire a time point at which energy of a frequency line corresponding to the magnitude spectrum of the target low-correlation signal is smaller than a fourth threshold and uses the acquired time point as the end time point; or determine a start time point of the next low-correlation signal as an end time point of the target low-correlation signal when energy of the target low-correlation signal is smaller than 1/m of energy of the next low-correlation signal.

In one optional embodiment, the acquiring module 1010 is further configured to extract channel signal segments in the start time point and the end time point.

The calculating module 1040 is further configured to: perform FFT on the channel signal segments to obtain signal segments subjected to FFT; extract a frequency line corresponding to the target low-correlation signal from the signal segments subjected to FFT to obtain a first portion signal; and perform IFFT and overlap-add on the first portion signal to obtain the rear/reverberation signal data in the corresponding channel high-frequency signal.

In one optional embodiment, the calculating module 1040 is further configured to perform scalar multiplication on the front left-channel signal and a volume of a front virtual left-channel speaker box to obtain the processed front left-channel signal, on the front right-channel signal and a volume of a front virtual right-channel speaker box to obtain the processed front right-channel signal, on the front center-channel signal and a volume of a front virtual center-channel speaker box to obtain the processed front center-channel signal, on the rear left-channel signal and a volume of a rear virtual left-channel speaker box to obtain the processed rear left-channel signal, and on the rear right-channel signal and a volume of a rear virtual right-channel speaker to obtain the processed rear right-channel signal.

In one optional embodiment, the 5.1-channel audio signals include a low-frequency channel signal.

The processing module 1020 is further configured to input the first stereo audio signal into a low-pass filter for filtering to obtain a first low-frequency signal.

The calculating module 1040 is further configured to perform scalar multiplication on the first low-frequency signal and a volume parameter of a low-frequency channel speaker box in the 5.1-channel virtual speaker box to obtain a second low-frequency signal, and perform mono conversion on the second low-frequency signal to obtain a processed low-frequency channel signal.

In one optional embodiment, the second low-frequency signal includes a left-channel low-frequency signal and a right-channel low-frequency signal.

The calculating module 1040 is further configured to superimpose the left-channel low-frequency signal over the right-channel low-frequency signal, then perform averaging, and use an averaged audio signal as the processed low-frequency channel signal.

Figure 11:
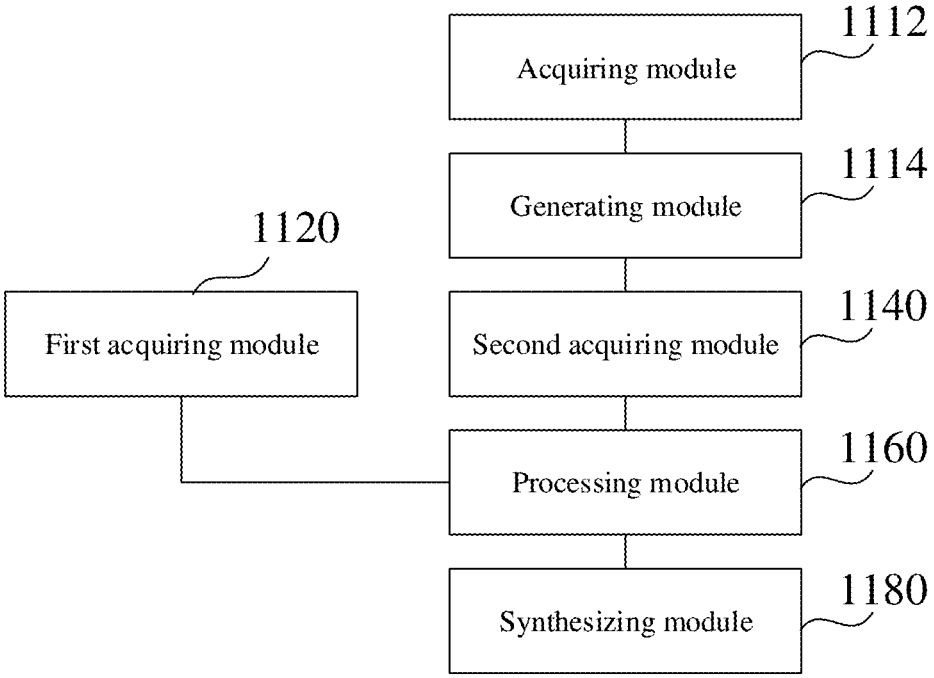
FIG. 11 is a block diagram of an audio signal processing apparatus in accordance with an exemplary embodiment of the present disclosure.

FIG. 11 is a structural block diagram of an audio signal processing apparatus in accordance with an exemplary embodiment of the present disclosure. The apparatus may be a terminal or part of the terminal and includes:

a first acquiring module 1120, configured to acquire 5.1-channel audio signals;

a second acquiring module 1140, configured to acquire HRTF data corresponding to each virtual speaker box in 5.1-channel virtual speaker boxes based on coordinates of the 5.1-channel virtual speaker boxes in a virtual environment;

a processing module 1160, configured to process the corresponding channel audio signal in the 5.1-channel audio signals based on the HRTF data corresponding to each virtual speaker box to obtain processed 5.1-channel audio signals; and a synthesizing module 1180, configured to synthesize the processed 5.1-channel audio signals into a stereo audio signal.

In one optional embodiment, the second acquisition module 1140 is configured to: acquire an HRTF database, wherein the HRTF database includes a corresponding relationship between at least one HRTF data sampling point and HRTF data, and each HRTF data sampling point has its own coordinates; and inquire the HRTF data sampling point nearest to an $i^{th}$ coordinate from the HRTF database based on the $i^{th}$ coordinate of an $i^{th}$ virtual speaker box in the 5.1 virtual speaker boxes and determine HRTF data of the HRTF data sampling point nearest to the $i^{th}$ coordinate as HRTF data of the $i^{th}$ virtual speaker box, wherein $i \geq 1$.

In one optional embodiment, the apparatus further includes:

an acquiring module 1112, configured to acquire a series of at least one HRTF datum that takes a reference head as the center of a sphere from an acoustic room and record position coordinates of HRTF data sampling points corresponding to each HRTF datum with respect to the reference head; and a generating module 1114, configured to generate an HRTF database based on the HRTF data, identifiers of the HRTF data sampling points and position coordinates of the HRTF data sampling points.

In one optional embodiment, the HRTF data include a left-channel HRTF coefficient.

The processing module 1160 includes:

a left-channel convoluting unit, configured to perform primary convolution on an $i^{th}$ channel audio signal in the 5.1-channel audio signals using the left-channel HRTF coefficient in the HRTF data corresponding to the $i^{th}$ virtual speaker box to obtain an $i^{th}$ channel audio signal subjected to the primary convolution; and a left-channel synthesizing unit, configured to superimpose all the channel audio signals subjected to the primary convolution to obtain a left-channel signal in a stereo audio signal.

In one optional embodiment, the HRTF data include a right-channel HRTF coefficient.

The processing module 1160 includes:

a right-channel convoluting unit, configured to perform secondary convolution on the $i^{th}$ channel audio signal in the 5.1-channel audio signals using the right-channel HRTF coefficient in the HRTF data corresponding to the $i^{th}$ virtual speaker box to obtain an $i^{th}$ channel audio signal subjected to the secondary convolution; and a right-channel synthesizing unit, configured to superimpose all the channel audio signals subjected to the secondary convolution to obtain a right-channel signal in the stereo audio signal.

Figure 12:
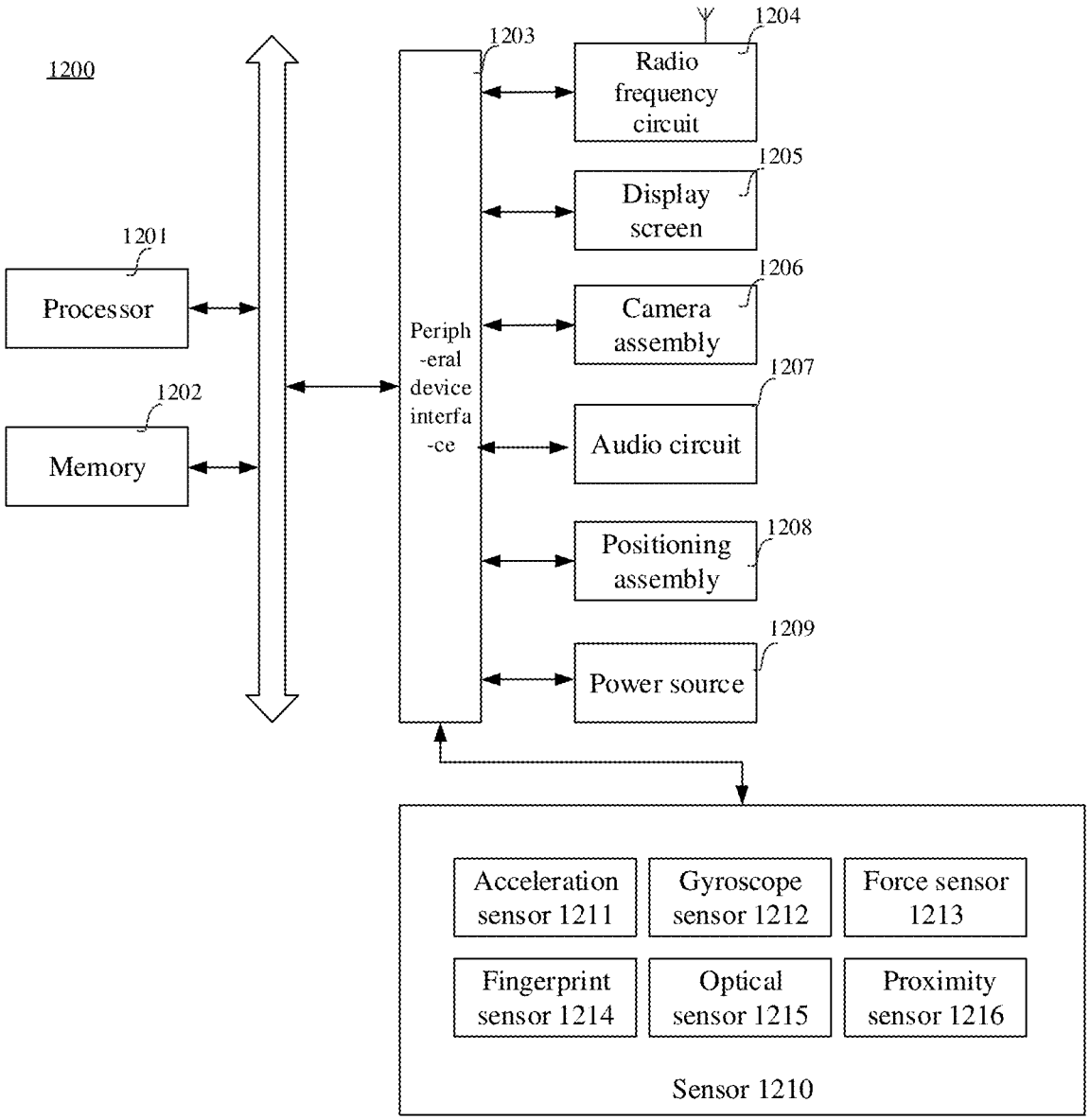
FIG. 12 is a block diagram of a terminal in accordance with an exemplary embodiment of the present disclosure.

FIG. 12 is a structural block diagram of a terminal 1200 according to an exemplary embodiment of the present disclosure. The terminal 1200 may be a smart phone, a tablet computer, a Moving Picture Experts Group Audio Layer III (MP3) player, a Moving Picture Experts Group Audio Layer IV (MP4) player, or a laptop or desktop computer. The terminal 1200 may also be referred to as a user equipment, a portable terminal, a laptop terminal, a desktop terminal, and the like.

Generally, the terminal 1200 includes a processor 1201 and a memory 1202.

The processor 1201 may include one or more processing cores, such as a 4-core processor, an 8-core processor, or the like. The processor 1201 may be implemented by using at least one of hardware forms in DSP (Digital Signal Processing), an field-programmable gate array (FPGA) and a programmable logic array (PLA). The processor 1201 may also include a main processor and a co-processor. The main processor is a processor for processing data in an awaken state, and is also called as a central processing unit (CPU). The co-processor is a low-power processor for processing data in a standby state. In some embodiments, the processor 1201 may be integrated with a GPU (Graphics Processing Unit) which is responsible for rendering and drawing of content required to be displayed by a display. In some embodiments, the processor 1201 may also include an artificial intelligence (AI) processor for processing a calculation operation related to machine learning.

The memory 1202 may include one or more computer-readable storage media which may be non-transitory. The memory 1202 may also include a high-speed random-access memory, as well as a non-volatile memory, such as one or more disk storage devices and flash storage devices. In some embodiments, the non-transitory computer-readable storage medium in the memory 1202 is configured to store at least one instruction which is executable by the processor 1201 to implement following processing:

acquire a first stereo audio signal;

split the first stereo audio signal into 5.1-channel audio signals;

obtain processed 5.1-channel audio signals by processing the 5.1-channel audio signals based on a speaker box parameter of a three-dimensional surround 5.1-channel virtual speaker box; and synthesize the processed 5.1-channel audio signals into a second stereo audio signal.

In a possible implement, the at least one instruction is executable by the processor 1201 to perform following processing:

obtain a first high-frequency signal by inputting the first stereo audio signal into a high-pass filter for filtering;

obtain a left-channel high-frequency signal, a center-channel high-frequency signal and a right-channel high-frequency signal by calculation based on the first high-frequency signal; and obtain a front left-channel signal, a front right-channel signal, a front center-channel signal, a low-frequency channel signal, a rear left-channel signal and a rear right-channel signal in the 5.1-channel audio signals by calculation based on the left-channel high-frequency signal, the center-channel high-frequency signal and the right-channel high-frequency signal.

In a possible implement, the at least one instruction is executable by the processor 1201 to perform following processing:

obtain a high-frequency real number signal and a high-frequency imaginary number signal by performing fast Fourier transform (FFT) on the first high-frequency signal;

calculate a vector projection based on the high-frequency real number signal and the high-frequency imaginary number signal;

obtain the center-channel high-frequency signal by performing FFT on a product of a left-channel high-frequency real number signal in the high-frequency real number signal and the vector projection;

determine a difference between a left-channel high-frequency signal in the first high-frequency signal and the center-channel high-frequency signal as the left-channel high-frequency signal; and determine a difference between a right-channel high-frequency signal in the first high-frequency signal and the center-channel high-frequency signal as the right-channel high-frequency signal.

In a possible implement, the at least one instruction is executable by the processor 1201 to perform following processing:

extract first rear/reverberation signal data in the left-channel high-frequency signal, second rear/reverberation signal data in the center-channel high-frequency signal and third rear/reverberation signal data in the right-channel high-frequency signal;

determine a difference between the left-channel high-frequency signal and the first rear/reverberation signal data as the front left-channel signal;

determine a sum of the first rear/reverberation signal data and the second rear/reverberation signal data as the rear left-channel signal;

determine a difference between the right-channel high-frequency signal and the third rear/reverberation signal data as the front right-channel signal;

determine a sum of the third rear/reverberation signal data and the second rear/reverberation signal data as the rear right-channel signal; and determine a difference between the center-channel high-frequency signal and the second rear/reverberation signal data as the front center-channel signal.

In a possible implement, the at least one instruction is executable by the processor 1201 to perform following processing:

obtain at least one moving window based on a sampling point in any of the left-channel high-frequency signal, the center-channel high-frequency signal and the right-channel high-frequency signal, wherein each moving window comprises n sampling points, and n/2 sampling points of every two adjacent moving windows are overlapping, $n \geq 1$;

calculate a low-correlation signal in the moving window and a start time point of the low-correlation signal, wherein the low-correlation signal comprises a signal of which a first decay envelope sequence in a magnitude spectrum and a second decay envelope sequence in a phase spectrum are unequal;

determine a target low-correlation signal that conforms to a rear/reverberation feature;

calculate an end time point of the target low-correlation signal; and extract the target low-correlation signal based on the start time point and the end time point, and taking the extracted target low-correlation signal as rear/reverberation signal data in the corresponding channel high-frequency signal.

In a possible implement, the at least one instruction is executable by the processor 1201 to perform following processing:

obtain a sampling point signal subjected to FFT by performing FFT on a sampling point signal in an $i^{th}$ moving window, wherein $i \geq 1$;

calculate a magnitude spectrum and a phase spectrum of the sampling point signal subjected to FFT:

calculate a first decay envelope sequence of m frequency lines in the $i^{th}$ moving window based on a magnitude spectrum of the sampling point signal subjected to FFT;

calculate a second decay envelope sequence of m frequency lines in the $i^{th}$ moving window based on a phase spectrum of the sampling point signal subjected to FFT;

determine a $j^{th}$ frequency line as the low-correlation signal when the decay envelope sequence and the second decay envelope sequence of the $j^{th}$ frequency line in the m frequency lines are different, wherein $1 \leq j \leq m$; and determine a start time point of the low-correlation signal based on a window number of the $i^{th}$ moving window and a frequency line number of the $j^{th}$ frequency line.

In a possible implement, the 5.1-channel audio signals comprise a low-frequency channel signal, the at least one instruction is executable by the processor 1201 to perform following processing:

input the first stereo audio signal into a low-pass filter for filtering to obtain a first low-frequency signal; and the obtain processed 5.1-channel audio signals by processing the 5.1-channel audio signals based on a speaker box parameter of a three-dimensional surround 5.1-channel virtual speaker comprises:

obtain a second low-frequency signal by performing scalar multiplication of the first low-frequency signal and a volume parameter of a low-frequency channel speaker box in the 5.1-channel virtual speaker box; and obtain a processed low-frequency channel signal by performing mono conversion on the second low-frequency signal.

In some embodiments, the terminal 1200 may optionally include a peripheral device interface 1203 and at least one peripheral device. The processor 1201, the memory 1202 and the peripheral device interface 1203 may be connected to each other via a bus or a signal line. The at least one peripheral device may be connected to the peripheral device interface 1203 via a bus, a signal line or a circuit board. Specifically, the peripheral device includes at least one of a radio frequency circuit 1204, a touch display screen 1205, a camera assembly 1206, an audio circuit 1207, a positioning assembly 1208 and a power source 1209.

The peripheral device interface 1203 may be configured to connect the at least one peripheral device related to input/output (I/O) to the processor 1201 and the memory 1202. In some embodiments, the processor 1201, the memory 1202 and the peripheral device interface 1203 are integrated on the same chip or circuit board. In some other embodiments, any one or two of the processor 1201, the memory 1202 and the peripheral device interface 1203 may be practiced on a separate chip or circuit board, which is not limited in this embodiment.

The radio frequency circuit 1204 is configured to receive and transmit a radio frequency (RF) signal, which is also referred to as an electromagnetic signal. The radio frequency circuit 1204 communicates with a communication network or another communication device via the electromagnetic signal. The radio frequency circuit 1204 converts an electrical signal to an electromagnetic signal and sends the signal, or converts a received electromagnetic signal to an electrical signal. Optionally, the radio frequency circuit 1204 includes an antenna system, an RF transceiver, one or a plurality of amplifiers, a tuner, an oscillator, a digital signal processor, a codec chip set, a subscriber identification module card or the like. The radio frequency circuit 1204 may communicate with another terminal based on a wireless communication protocol. The wireless communication protocol includes, but not limited to: a metropolitan area network, generations of mobile communication networks (including 2G, 3G, 4G and 5G), a wireless local area network and/or a wireless fidelity (WiFi) network. In some embodiments, the radio frequency circuit 1204 may further include a near field communication (NFC)-related circuits, which is not limited in the present disclosure.

The display screen 1205 may be configured to display a user interface (UI). The UE may include graphics, texts, icons, videos and any combination thereof. When the display screen 1205 is a touch display screen, the display screen 1205 may further have the capability of acquiring a touch signal on a surface of the display screen 1205 or above the surface of the display screen 1205. The touch signal may be input to the processor 1201 as a control signal, and further processed therein. In this case, the display screen 1205 may be further configured to provide a virtual button and/or a virtual keyboard or keypad, also referred to as a soft button and/or a soft keyboard or keypad. In some embodiments, one display screen 1205 may be provided, which is arranged on a front panel of the terminal 1200. In some other embodiments, at least two display screens 1205 are provided, which are respectively arranged on different surfaces of the terminal 1200 or designed in a folded fashion. In still some other embodiments, the display screen 1205 may be a flexible display screen, which is arranged on a bent surface or a folded surface of the terminal 1200. Even, the display screen 1205 may be further arranged to an irregular pattern which is non-rectangular, that is, a specially-shaped screen. The display screen 1205 may be fabricated from such materials as a liquid crystal display (LCD), an organic light-emitting diode (OLED) and the like.

The camera assembly 1206 is configured to capture an image or a video. Optionally, the camera assembly 1206 includes a front camera and a rear camera. Generally, the front camera is arranged on a front panel of the terminal, and the rear camera is arranged on a rear panel of the terminal. In some embodiments, at least two rear cameras are arranged, which are respectively any one of a primary camera, a depth of field (DOF) camera, a wide-angle camera and a long-focus camera, such that the primary camera and the DOF camera are fused to implement the background virtualization function, and the primary camera and the wide-angle camera are fused to implement the panorama photographing and virtual reality (VR) photographing functions or other fused photographing functions. In some embodiments, the camera assembly 1206 may further include a flash. The flash may be a single-color temperature flash or a double-color temperature flash. The double-color temperature flash refers to a combination of a warm-light flash and a cold-light flash, which may be used for light compensation under different color temperatures.

The audio circuit 1207 may include a microphone and a speaker. The microphone is configured to capture an acoustic wave of a user and an environment, and convert the acoustic wave to an electrical signal and output the electrical signal to the processor 1201 for further processing, or output to the radio frequency circuit 1204 to implement voice communication. For the purpose of stereo capture or noise reduction, a plurality of such microphones may be provided, which are respectively arranged at different positions of the terminal 1200. The microphone may also be a microphone array or an omnidirectional capturing microphone. The speaker is configured to convert an electrical signal from the processor 1201 or the radio frequency circuit 1204 to an acoustic wave. The speaker may be a traditional thin-film speaker, or may be a piezoelectric ceramic speaker. When the speaker is a piezoelectric ceramic speaker, an electrical signal may be converted to an acoustic wave audible by human beings, or an electrical signal may be converted to an acoustic wave inaudible by human beings for the purpose of ranging or the like. In some embodiments, the audio circuit 1207 may further include a headphone plug.

The positioning assembly 1208 is configured to determine a current geographical position of the terminal 1200 to implement navigation or a local based service (LBS). The positioning assembly 1208 may be the global positioning system (GPS) from the United States, the Beidou positioning system from China, the Grenas satellite positioning system from Russia or the Galileo satellite navigation system from the European Union.

The power source 1209 is configured to supply power for the components in the terminal 1200. The power source 1209 may be an alternating current, a direct current, a disposable battery or a rechargeable battery. When the power source 1209 includes a rechargeable battery, the rechargeable battery may support wired charging or wireless charging. The rechargeable battery may also support the supercharging technology.

In some embodiments, the terminal 1200 may further include one or a plurality of sensors 1210. The one or plurality of sensors 1210 include, but not limited to: an acceleration sensor 1211, a gyroscope sensor 1212, a pressure sensor 1213, a fingerprint sensor 1214, an optical sensor 1215 and a proximity sensor 1216.

The acceleration sensor 1211 may detect accelerations on three coordinate axes in a coordinate system established for the terminal 1200. For example, the acceleration sensor 1211 may be configured to detect components of a gravity acceleration on the three coordinate axes. The processor 1201 may control the touch display screen 1205 to display the user interface in a horizontal view or a longitudinal view based on a gravity acceleration signal acquired by the acceleration sensor 1211. The acceleration sensor 1211 may be further configured to acquire motion data of a game or a user.

The gyroscope sensor 1212 may detect a direction and a rotation angle of the terminal 1200, and the gyroscope sensor 1212 may collaborate with the acceleration sensor 1211 to capture a three-dimensional action performed by the user for the terminal 1200. Based on the data acquired by the gyroscope sensor 1212, the processor 1201 may implement the following functions: action sensing (for example, modifying the UE based on an inclination operation of the user), image stabilization during the photographing, game control and inertial navigation.

The force sensor 1213 may be arranged on a side frame of the terminal and/or on a lowermost layer of the touch display screen 1205. When the force sensor 1213 is arranged on the side frame of the terminal 1200, a grip signal of the user against the terminal 1200 may be detected, and the processor 1201 implements left or right hand identification or perform a shortcut operation based on the grip signal acquired by the force sensor 1213. When the force sensor 1213 is arranged on the lowermost layer of the touch display screen 1205, the processor 1201 implement control of an operable control on the UI based on a force operation of the user against the touch display screen 1205. The operable control includes at least one of a button control, a scroll bar control, an icon control, and a menu control.

The fingerprint sensor 1214 is configured to acquire fingerprints of the user, and the processor 1201 determines the identity of the user based on the fingerprints acquired by the fingerprint sensor 1214, or the fingerprint sensor 1214 determines the identity of the user based on the acquired fingerprints. When it is determined that the identify of the user is trustable, the processor 1201 authorizes the user to perform related sensitive operations, wherein the sensitive operations include unlocking the screen, checking encrypted information, downloading software, paying and modifying settings and the like. The fingerprint sensor 1214 may be arranged on a front face a back face or a side face of the terminal 1200. When the terminal 1200 is provided with a physical key or a manufacturer's logo, the fingerprint sensor 1214 may be integrated with the physical key or the manufacturer's logo.

The optical sensor 1215 is configured to acquire the intensity of ambient light. In one embodiment, the processor 1201 may control a display luminance of the touch display screen 1205 based on the intensity of ambient light acquired by the optical sensor 1215. Specifically, when the intensity of ambient light is high, the display luminance of the touch display screen 1205 is up-shifted; and when the intensity of ambient light is low, the display luminance of the touch display screen 1205 is down-shifted. In another embodiment, the processor 1201 may further dynamically adjust photographing parameters of the camera assembly 1206 based on the intensity of ambient light acquired by the optical sensor.

The proximity sensor 1216, also referred to as a distance sensor, is generally arranged on the front panel of the terminal 1200. The proximity sensor 1216 is configured to acquire a distance between the user and the front face of the terminal 1200. In one embodiment, when the proximity sensor 1216 detects that the distance between the user and the front face of the terminal 1200 gradually decreases, the processor 1201 controls the touch display screen 1205 to switch from an active state to a rest state; and when the proximity sensor 1216 detects that the distance between the user and the front face of the terminal 1200 gradually increases, the processor 1201 controls the touch display screen 1205 to switch from the rest state to the active state.

A person skilled in the art may understand that the structure of the terminal as illustrated in FIG. 12 does not construe a limitation on the terminal 1200. The terminal may include more components over those illustrated in FIG. 12, or combinations of some components, or employ different component deployments.

The present disclosure further provides a computer-readable storage medium. At least one instruction is stored in the storage medium and loaded and executed by a processor to implement following processing:

acquire a first stereo audio signal;

split the first stereo audio signal into 5.1-channel audio signals;

obtain processed 5.1-channel audio signals by processing the 5.1-channel audio signals based on a speaker box parameter of a three-dimensional surround 5.1-channel virtual speaker box; and synthesize the processed 5.1-channel audio signals into a second stereo audio signal.

In a possible implement, the at least one instruction is executable by the processor 1201 to perform following processing:

obtain a first high-frequency signal by inputting the first stereo audio signal into a high-pass filter for filtering;

obtain a left-channel high-frequency signal, a center-channel high-frequency signal and a right-channel high-frequency signal by calculation based on the first high-frequency signal; and obtain a front left-channel signal, a front right-channel signal, a front center-channel signal, a low-frequency channel signal, a rear left-channel signal and a rear right-channel signal in the 5.1-channel audio signals by calculation based on the left-channel high-frequency signal, the center-channel high-frequency signal and the right-channel high-frequency signal.

In a possible implement, the at least one instruction is executable by the processor 1201 to perform following processing:

obtain a high-frequency real number signal and a high-frequency imaginary number signal by performing fast Fourier transform (FFT) on the first high-frequency signal;

calculate a vector projection based on the high-frequency real number signal and the high-frequency imaginary number signal;

obtain the center-channel high-frequency signal by performing FFT on a product of a left-channel high-frequency real number signal in the high-frequency real number signal and the vector projection;

determine a difference between a left-channel high-frequency signal in the first high-frequency signal and the center-channel high-frequency signal as the left-channel high-frequency signal; and determine a difference between a right-channel high-frequency signal in the first high-frequency signal and the center-channel high-frequency signal as the right-channel high-frequency signal.

In a possible implement, the at least one instruction is executable by the processor 1201 to perform following processing:

extract first rear/reverberation signal data in the left-channel high-frequency signal, second rear/reverberation signal data in the center-channel high-frequency signal and third rear/reverberation signal data in the right-channel high-frequency signal;

determine a difference between the left-channel high-frequency signal and the first rear/reverberation signal data as the front left-channel signal;

determine a sum of the first rear/reverberation signal data and the second rear/reverberation signal data as the rear left-channel signal;

determine a difference between the right-channel high-frequency signal and the third rear/reverberation signal data as the front right-channel signal;

determine a sum of the third rear/reverberation signal data and the second rear/reverberation signal data as the rear right-channel signal; and determine a difference between the center-channel high-frequency signal and the second rear/reverberation signal data as the front center-channel signal.

In a possible implement, the at least one instruction is executable by the processor 1201 to perform following processing:

obtain at least one moving window based on a sampling point in any of the left-channel high-frequency signal, the center-channel high-frequency signal and the right-channel high-frequency signal, wherein each moving window comprises n sampling points, and n/2 sampling points of every two adjacent moving windows are overlapping, $n \geq 1$;

calculate a low-correlation signal in the moving window and a start time point of the low-correlation signal, wherein the low-correlation signal comprises a signal of which a first decay envelope sequence in a magnitude spectrum and a second decay envelope sequence in a phase spectrum are unequal;

determine a target low-correlation signal that conforms to a rear/reverberation feature;

calculate an end time point of the target low-correlation signal; and extract the target low-correlation signal based on the start time point and the end time point, and taking the extracted target low-correlation signal as rear/reverberation signal data in the corresponding channel high-frequency signal.

In a possible implement, the at least one instruction is executable by the processor 1201 to perform following processing:

obtain a sampling point signal subjected to FFT by performing FFT on a sampling point signal in an $i^{th}$ moving window, wherein $i \geq 1$;

calculate a magnitude spectrum and a phase spectrum of the sampling point signal subjected to FFT;

calculate a first decay envelope sequence of m frequency lines in the $i^{th}$ moving window based on a magnitude spectrum of the sampling point signal subjected to FFT;

calculate a second decay envelope sequence of m frequency lines in the $i^{th}$ moving window based on a phase spectrum of the sampling point signal subjected to FFT;

determine a $j^{th}$ frequency line as the low-correlation signal when the decay envelope sequence and the second decay envelope sequence of the $j^{th}$ frequency line in the m frequency lines are different, wherein $1 \leq j \leq m$; and determine a start time point of the low-correlation signal based on a window number of the $i^{th}$ moving window and a frequency line number of the $j^{th}$ frequency line.

In a possible implement, the 5.1-channel audio signals comprise a low-frequency channel signal, the at least one instruction is executable by the processor 1201 to perform following processing:

input the first stereo audio signal into a low-pass filter for filtering to obtain a first low-frequency signal; and the obtain processed 5.1-channel audio signals by processing the 5.1-channel audio signals based on a speaker box parameter of a three-dimensional surround 5.1-channel virtual speaker comprises:

obtain a second low-frequency signal by performing scalar multiplication of the first low-frequency signal and a volume parameter of a low-frequency channel speaker box in the 5.1-channel virtual speaker box; and obtain a processed low-frequency channel signal by performing mono conversion on the second low-frequency signal.

Optionally, the present disclosure further provides a computer program product including an instruction. A computer on which the computer program product runs executes the audio signal processing method described in the above aspects.

It is to be understood that the term "plurality" herein refers to two or more. "And/or" herein describes the correspondence of the corresponding objects, indicating three kinds of relationship. For example, A and/or B, may be expressed as: A exists alone, A and B exist concurrently, B exists alone. The character "/" generally indicates that the context object is an "OR" relationship.

The serial numbers of the above embodiments of the present application are merely for description, instead of indicating the merits or demerits of the embodiments.

Persons of ordinary skill in the art can understand that all or part of the steps described in the above embodiments may be completed by hardware, or by relevant hardware instructed by applications stored in a non-transitory computer readable storage medium, such as a read-only memory, a disk or a CD.

Described above are merely exemplary embodiments of the present disclosure, and are not intended to limit the present disclosure. Within the spirit and principles of the disclosure, any modifications, equivalent substitutions, or improvements are within the protection scope of the present disclosure.

What is claimed is:

1. An audio signal processing method, the method being performed by a terminal, and comprising:

acquiring a first stereo audio signal;

splitting the first stereo audio signal into 5.1-channel audio signals;

obtaining processed 5.1-channel audio signals by processing the 5.1-channel audio signals based on a speaker box parameter of a three-dimensional surround 5.1-channel virtual speaker box; and synthesizing the processed 5.1-channel audio signals into a second stereo audio signal, wherein the splitting the first stereo audio signal into 5.1-channel audio signals comprises:

obtaining a first high-frequency signal by inputting the first stereo audio signal into a high-pass filter for filtering;

obtaining a left-channel high-frequency signal, a center-channel high-frequency signal and a right-channel high-frequency signal by calculation based on the first high-frequency signal;

extracting first rear/reverberation signal data in the left-channel high-frequency signal, second rear/reverberation signal data in the center-channel high-frequency signal and third rear/reverberation signal data in the right-channel high-frequency signal;

determining a difference between the left-channel high-frequency signal and the first rear/reverberation signal data as the front left-channel signal;

determining a sum of the first rear/reverberation signal data and the second rear/reverberation signal data as the rear left-channel signal;

determining a difference between the right-channel high-frequency signal and the third rear/reverberation signal data as the front right-channel signal;

determining a sum of the third rear/reverberation signal data and the second rear/reverberation signal data as the rear right-channel signal; and determining a difference between the center-channel high-frequency signal and the second rear/reverberation signal data as the front center-channel signal.

2. The method according to claim 1, wherein the obtaining a left-channel high-frequency signal, a center-channel high-frequency signal and a right-channel high-frequency signal by calculation based on the first high-frequency signal comprises:

obtaining a high-frequency real number signal and a high-frequency imaginary number signal by performing fast Fourier transform (FFT) on the first high-frequency signal;

calculating a vector projection based on the high-frequency real number signal and the high-frequency imaginary number signal;

obtaining the center-channel high-frequency signal by performing FFT on a product of a left-channel high-frequency real number signal in the high-frequency real number signal and the vector projection;

determining a difference between a left-channel high-frequency signal in the first high-frequency signal and the center-channel high-frequency signal as the left-channel high-frequency signal; and determining a difference between a right-channel high-frequency signal in the first high-frequency signal and the center-channel high-frequency signal as the right-channel high-frequency signal.

3. The method according to claim 1, wherein the extracting first rear/reverberation signal data in the left-channel high-frequency signal, second rear/reverberation signal data in the center-channel high-frequency signal and third rear/reverberation signal data in the right-channel high-frequency signal comprises:

obtaining at least one moving window based on a sampling point in any of the left-channel high-frequency signal, the center-channel high-frequency signal and the right-channel high-frequency signal, wherein each moving window comprises n sampling points, and n/2 sampling points of every two adjacent moving windows are overlapping, $n \geq 1$;

calculating a low-correlation signal in the moving window and a start time point of the low-correlation signal, wherein the low-correlation signal comprises a signal of which a first decay envelope sequence in a magnitude spectrum and a second decay envelope sequence in a phase spectrum are unequal;

determining a target low-correlation signal that conforms to a rear/reverberation feature;

calculating an end time point of the target low-correlation signal; and extracting the target low-correlation signal based on the start time point and the end time point, and taking the extracted target low-correlation signal as rear/reverberation signal data in the corresponding channel high-frequency signal.

4. The method according to claim 3, wherein the calculating a low-correlation signal in the moving window and a start time point of the low-correlation signal comprises:

obtaining a sampling point signal subjected to FFT by performing FFT on a sampling point signal in an $i^{th}$ moving window, wherein $i \geq 1$;

calculating a magnitude spectrum and a phase spectrum of the sampling point signal subjected to FFT;

calculating a first decay envelope sequence of m frequency lines in the $i^{th}$ moving window based on a magnitude spectrum of the sampling point signal subjected to FFT;

calculating a second decay envelope sequence of m frequency lines in the $i^{th}$ moving window based on a phase spectrum of the sampling point signal subjected to FFT;

determining a $j^{th}$ frequency line as the low-correlation signal when the decay envelope sequence and the second decay envelope sequence of the $j^{th}$ frequency line in the m frequency lines are different, wherein $1 \leq j \leq m$; and determining a start time point of the low-correlation signal based on a window number of the $i^{th}$ moving window and a frequency line number of the $j^{th}$ frequency line.

5. The method according to claim 1, wherein the 5.1-channel audio signals comprise a low-frequency channel signal;

the splitting the first stereo audio signal into 5.1-channel audio signals comprises:

inputting the first stereo audio signal into a low-pass filter for filtering to obtain a first low-frequency signal; and the obtaining processed 5.1-channel audio signals by processing the 5.1-channel audio signals based on a speaker box parameter of a three-dimensional surround 5.1-channel virtual speaker comprises:

obtaining a second low-frequency signal by performing scalar multiplication of the first low-frequency signal and a volume parameter of a low-frequency channel speaker box in the 5.1-channel virtual speaker box; and obtaining a processed low-frequency channel signal by performing mono conversion on the second low-frequency signal.

6. A terminal, comprising a processor and a memory, wherein at least one instruction is stored in the memory, and loaded and executed by the processor to perform following processing:

acquire a first stereo audio signal;

split the first stereo audio signal into 5.1-channel audio signals;

obtain processed 5.1-channel audio signals by processing the 5.1-channel audio signals based on a speaker box parameter of a three-dimensional surround 5.1-channel virtual speaker box; and synthesize the processed 5.1-channel audio signals into a second stereo audio signal, wherein the at least one instruction is executable by the processor to perform following processing:

obtain a first high-frequency signal by inputting the first stereo audio signal into a high-pass filter for filtering;

obtain a left-channel high-frequency signal, a center-channel high-frequency signal and a right-channel high-frequency signal by calculation based on the first high-frequency signal;

extract first rear/reverberation signal data in the left-channel high-frequency signal, second rear/reverberation signal data in the center-channel high-frequency signal and third rear/reverberation signal data in the right-channel high-frequency signal;

determine a difference between the left-channel high-frequency signal and the first rear/reverberation signal data as the front left-channel signal;

determine a sum of the first rear/reverberation signal data and the second rear/reverberation signal data as the rear left-channel signal;

determine a difference between the right-channel high-frequency signal and the third rear/reverberation signal data as the front right-channel signal;

determine a sum of the third rear/reverberation signal data and the second rear/reverberation signal data as the rear right-channel signal; and determine a difference between the center-channel high-frequency signal and the second rear/reverberation signal data as the front center-channel signal.

7. The terminal according to claim 6, the at least one instruction is executable by the processor to perform following processing:

obtain a high-frequency real number signal and a high-frequency imaginary number signal by performing fast Fourier transform (FFT) on the first high-frequency signal;

calculate a vector projection based on the high-frequency real number signal and the high-frequency imaginary number signal;

obtain the center-channel high-frequency signal by performing FFT on a product of a left-channel high-frequency real number signal in the high-frequency real number signal and the vector projection;

determine a difference between a left-channel high-frequency signal in the first high-frequency signal and the center-channel high-frequency signal as the left-channel high-frequency signal; and determine a difference between a right-channel high-frequency signal in the first high-frequency signal and the center-channel high-frequency signal as the right-channel high-frequency signal.

8. The terminal according to claim 6, the at least one instruction is executable by the processor to perform following processing:

obtain at least one moving window based on a sampling point in any of the left-channel high-frequency signal, the center-channel high-frequency signal and the right-channel high-frequency signal, wherein each moving window comprises n sampling points, and n/2 sampling points of every two adjacent moving windows are overlapping, $n \geq 1$;

calculate a low-correlation signal in the moving window and a start time point of the low-correlation signal, wherein the low-correlation signal comprises a signal of which a first decay envelope sequence in a magnitude spectrum and a second decay envelope sequence in a phase spectrum are unequal;

determine a target low-correlation signal that conforms to a rear/reverberation feature;

calculate an end time point of the target low-correlation signal; and extract the target low-correlation signal based on the start time point and the end time point, and taking the extracted target low-correlation signal as rear/reverberation signal data in the corresponding channel high-frequency signal.

9. The terminal according to claim 8, the at least one instruction is executable by the processor to perform following processing:

obtain a sampling point signal subjected to FFT by performing FFT on a sampling point signal in an $i^{th}$ moving window, wherein $i \geq 1$;

calculate a magnitude spectrum and a phase spectrum of the sampling point signal subjected to FFT;

calculate a first decay envelope sequence of m frequency lines in the $i^{th}$ moving window based on a magnitude spectrum of the sampling point signal subjected to FFT;

calculate a second decay envelope sequence of m frequency lines in the $i^{d}$ moving window based on a phase spectrum of the sampling point signal subjected to FFT;

determine a $j^{th}$ frequency line as the low-correlation signal when the decay envelope sequence and the second decay envelope sequence of the $j^{th}$ frequency line in the m frequency lines are different, wherein $1 \leq j \leq m$; and determine a start time point of the low-correlation signal based on a window number of the $i^{th}$ moving window and a frequency line number of the $j^{th}$ frequency line.

10. The terminal according to claim 6, the 5.1-channel audio signals comprise a low-frequency channel signal, the at least one instruction is executable by the processor to perform following processing:

input the first stereo audio signal into a low-pass filter for filtering to obtain a first low-frequency signal; and the obtain processed 5.1-channel audio signals by processing the 5.1-channel audio signals based on a speaker box parameter of a three-dimensional surround 5.1-channel virtual speaker comprises:

obtain a second low-frequency signal by performing scalar multiplication of the first low-frequency signal and a volume parameter of a low-frequency channel speaker box in the 5.1-channel virtual speaker box; and obtain a processed low-frequency channel signal by performing mono conversion on the second low-frequency signal.

11. A non-transitory computer-readable storage medium, wherein at least one instruction is stored in the storage medium, and loaded and executed by a processor to following processing:

acquire a first stereo audio signal;

split the first stereo audio signal into 5.1-channel audio signals;

obtain processed 5.1-channel audio signals by processing the 5.1-channel audio signals based on a speaker box parameter of a three-dimensional surround 5.1-channel virtual speaker box; and synthesize the processed 5.1-channel audio signals into a second stereo audio signal, wherein the at least one instruction is executable by the processor to perform following processing:

obtain a first high-frequency signal by inputting the first stereo audio signal into a high-pass filter for filtering;

obtain a left-channel high-frequency signal, a center-channel high-frequency signal and a right-channel high-frequency signal by calculation based on the first high-frequency signal;

extract first rear/reverberation signal data in the left-channel high-frequency signal, second rear/reverberation signal data in the center-channel high-frequency signal and third rear/reverberation signal data in the right-channel high-frequency signal;

determine a difference between the left-channel high-frequency signal and the first rear/reverberation signal data as the front left-channel signal;

determine a sum of the first rear/reverberation signal data and the second rear/reverberation signal data as the rear left-channel signal;

determine a difference between the right-channel high-frequency signal and the third rear/reverberation signal data as the front right-channel signal;

determine a sum of the third rear/reverberation signal data and the second rear/reverberation signal data as the rear right-channel signal; and determine a difference between the center-channel high-frequency signal and the second rear/reverberation signal data as the front center-channel signal.

12. The non-transitory computer-readable storage medium according to claim 11, the at least one instruction is executable by the processor to perform following processing:

obtain a high-frequency real number signal and a high-frequency imaginary number signal by performing fast Fourier transform (FFT) on the first high-frequency signal;

calculate a vector projection based on the high-frequency real number signal and the high-frequency imaginary number signal;

obtain the center-channel high-frequency signal by performing FFT on a product of a left-channel high-frequency real number signal in the high-frequency real number signal and the vector projection;

determine a difference between a left-channel high-frequency signal in the first high-frequency signal and the center-channel high-frequency signal as the left-channel high-frequency signal; and determine a difference between a right-channel high-frequency signal in the first high-frequency signal and the center-channel high-frequency signal as the right-channel high-frequency signal.

13. The non-transitory computer-readable storage medium according to claim 11, the at least one instruction is executable by the processor to perform following processing:

obtain at least one moving window based on a sampling point in any of the left-channel high-frequency signal, the center-channel high-frequency signal and the right-channel high-frequency signal, wherein each moving window comprises n sampling points, and n/2 sampling points of every two adjacent moving windows are overlapping, $n \geq 1$;

calculate a low-correlation signal in the moving window and a start time point of the low-correlation signal, wherein the low-correlation signal comprises a signal of which a first decay envelope sequence in a magnitude spectrum and a second decay envelope sequence in a phase spectrum are unequal;

determine a target low-correlation signal that conforms to a rear/reverberation feature;

calculate an end time point of the target low-correlation signal; and extract the target low-correlation signal based on the start time point and the end time point, and taking the extracted target low-correlation signal as rear/reverberation signal data in the corresponding channel high-frequency signal.

14. The non-transitory computer-readable storage medium according to claim 11, the 5.1-channel audio signals comprise a low-frequency channel signal, the at least one instruction is executable by the processor to perform following processing:

input the first stereo audio signal into a low-pass filter for filtering to obtain a first low-frequency signal; and the obtain processed 5.1-channel audio signals by processing the 5.1-channel audio signals based on a speaker box parameter of a three-dimensional surround 5.1-channel virtual speaker comprises:

obtain a second low-frequency signal by performing scalar multiplication of the first low-frequency signal and a volume parameter of a low-frequency channel speaker box in the 5.1-channel virtual speaker box; and obtain a processed low-frequency channel signal by performing mono conversion on the second low-frequency signal.

* * * * *